US008220071B2

(12) United States Patent
Rhoades et al.

(10) Patent No.: US 8,220,071 B2
(45) Date of Patent: Jul. 17, 2012

(54) BALL GLOVE INCORPORATING A FORCE ATTENUATION SYSTEM

(75) Inventors: Matthew A. Rhoades, Portland, OR (US); Joe Watson, Portland, OR (US); Mark McNamee, Portland, OR (US); Barry Plocher, Potland, OR (US)

(73) Assignee: NIKE, Inc., Beaverton, OR (US)

( * ) Notice: Subject to any disclaimer, the term of this patent is extended or adjusted under 35 U.S.C. 154(b) by 101 days.

(21) Appl. No.: 12/507,146

(22) Filed: Jul. 22, 2009

(65) Prior Publication Data

US 2011/0016596 A1 Jan. 27, 2011

(51) Int. Cl.
*A41D 13/08* (2006.01)

(52) U.S. Cl. ..... 2/19; 2/16; 2/20; 2/161.1

(58) Field of Classification Search ..... 2/16, 19, 2/20, 161.1

See application file for complete search history.

(56) References Cited

U.S. PATENT DOCUMENTS

| | | | | |
|---|---|---|---|---|
| 3,890,648 | A | 6/1975 | Beal | |
| 5,113,530 | A * | 5/1992 | Smith | 2/19 |
| 5,159,717 | A | 11/1992 | Drew et al. | |
| 5,218,719 | A | 6/1993 | Johnson | |
| 5,285,529 | A * | 2/1994 | Arena | 2/20 |
| 5,297,541 | A | 3/1994 | Hensey | |
| 5,398,342 | A | 3/1995 | Kinnee et al. | |
| 5,427,577 | A | 6/1995 | Picchietti | |
| 6,634,029 | B1 * | 10/2003 | Sullivano et al. | 2/19 |
| 7,025,709 | B2 * | 4/2006 | Riggall | 482/49 |
| 7,131,218 | B2 | 11/2006 | Schindler | |
| 7,150,048 | B2 * | 12/2006 | Buckman | 2/465 |
| 7,588,654 | B2 | 9/2009 | Schindler | |
| 2003/0051285 | A1 * | 3/2003 | Bower | 2/16 |
| 2006/0064801 | A1 | 3/2006 | Johnson | |
| 2006/0230636 | A1 | 10/2006 | Kokstis | |

* cited by examiner

*Primary Examiner* — Khoa Huynh
*Assistant Examiner* — Andrew W Collins
(74) *Attorney, Agent, or Firm* — Plumsea Law Group, LLC

(57) ABSTRACT

A ball glove having a palmar panel, a dorsal panel, and a webbing may have a palmar force attenuation system, a dorsal force attenuation system, or both. The palmar panel and dorsal panel may define a hand cavity having five finger voids. The webbing may be secured to the ball glove and may be positioned between finger voids for the thumb and index fingers. A palmar force attenuation system may include at least one chamber sealed to enclose a fluid. A majority of the palmar force attenuation system may be positioned between the front surface of the palmar panel and the hand void. The palmar force attenuation system may be L-shaped, and it may enclose a foam structure. A dorsal force attenuation system may include at least one chamber sealed to enclose a fluid and may be secured to the dorsal panel.

19 Claims, 23 Drawing Sheets

BALL GLOVE INCORPORATING A FORCE ATTENUATION SYSTEM

BACKGROUND

Ball gloves are used by athletes in sports such as baseball and softball to assist in catching balls. Although conventional ball gloves may have similar configurations, features of particular ball gloves may be directed toward use in particular positions within a baseball or softball team. For example, ball gloves may be configured for use as pitcher's gloves, catcher's mitts, infielder's gloves, outfielder's gloves, or first basemen's mitts.

Conventional ball gloves include three primary elements: a palmar panel, a dorsal panel, and a webbing. Although many ball gloves are primarily formed from leather elements that are stitched, laced, or adhesively bonded together, synthetic leather, foam, textile, and rubber elements may also be utilized. The palmar panel and dorsal panel form a hand cavity that includes a palm void and a plurality of finger voids for receiving a hand of a wearer. More particularly, the palmar panel and the dorsal panel form a palm area in which the palm void is located and a plurality of finger stalls in which the finger voids are located. Although the webbing may have a variety of configurations, a common form for the webbing includes a plurality of interlaced strips (e.g., leather strips) that are positioned between finger stalls for the thumb and index fingers. The palmar panel, the dorsal panel, and the webbing typically form a pocket that facilitates catching balls and protects the hand from repeated impacts with the balls.

SUMMARY

Various features of palmar force attenuation systems and dorsal force attenuation systems, which may be incorporated into ball gloves and other products, are disclosed below.

One aspect relates to a ball glove having a palmar panel, a dorsal panel, a webbing, and a palmar force attenuation system. The palmar panel and the dorsal panel are coupled together. The palmer panel and the dorsal panel define a hand cavity. The hand cavity includes a palm void, a first finger void, a second finger void, a third finger void, a fourth finger void, and a fifth finger void, the finger voids extending outward from the palm void. The webbing is secured to at least one of the palmar panel and the dorsal panel and is positioned between the first finger void and the second finger void. The palmar force attenuation system includes at least one chamber sealed to enclose a fluid. A majority of the palmar force attenuation system is positioned between the front surface of the glove and the second finger void, a portion of the palm void adjacent to the second finger void, and a portion of the palm void adjacent to the third finger void.

Another aspect relates to a ball glove having a palmar panel, a dorsal panel, a webbing, and a dorsal force attenuation system. The palmar panel and the dorsal panel are coupled together. The palmer panel and the dorsal panel define a hand cavity. The hand cavity includes a palm void, a first finger void, a second finger void, a third finger void, a fourth finger void, and a fifth finger void, the finger voids extending outward from the palm void. The webbing is secured to at least one of the palmar panel and the dorsal panel and is positioned between the first finger void and the second finger void. The dorsal force attenuation system includes at least one chamber sealed to enclose a fluid and is secured to the dorsal panel.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
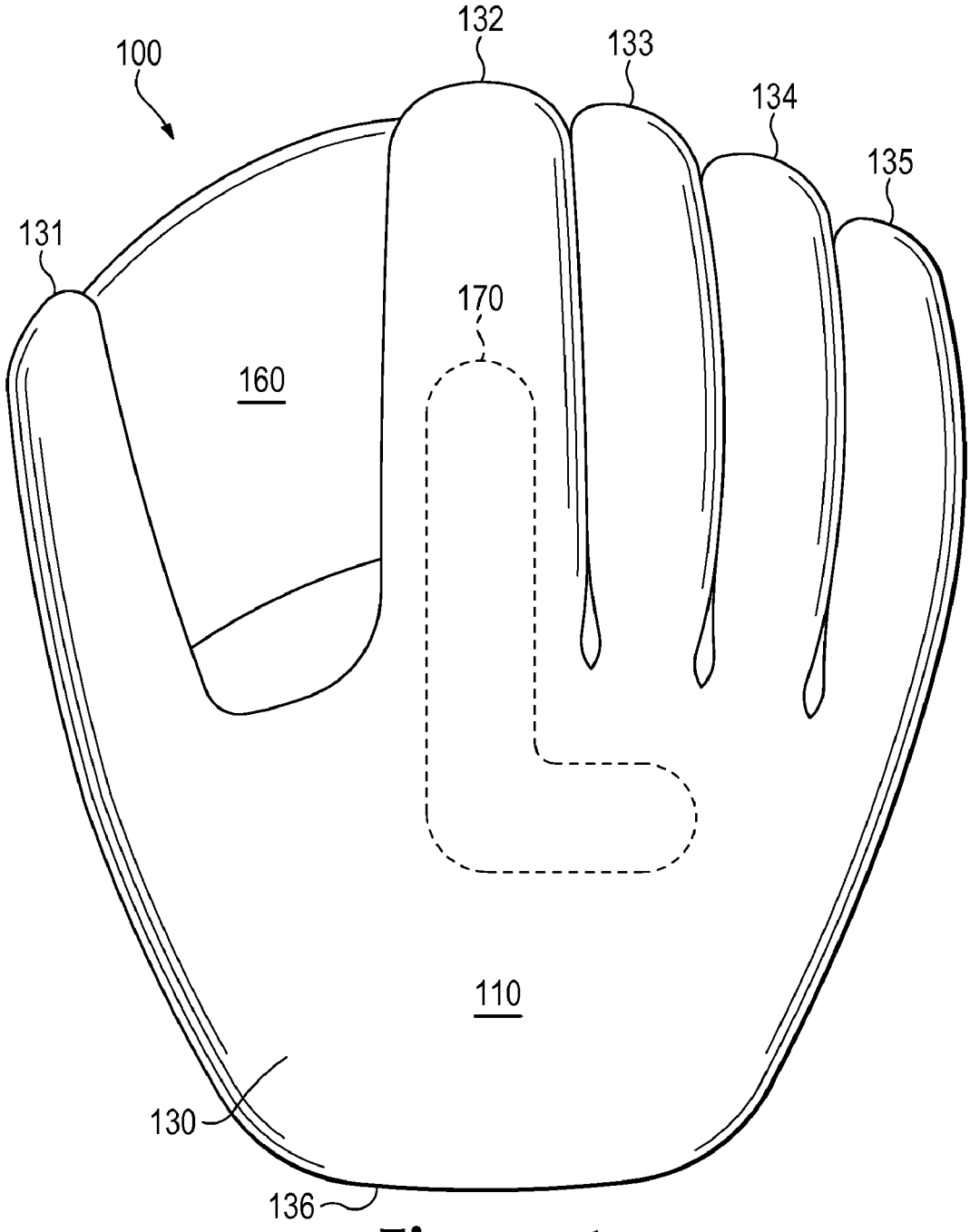
FIG. 1 is an elevational view of a palmar side of a first ball glove.
Figure 2:
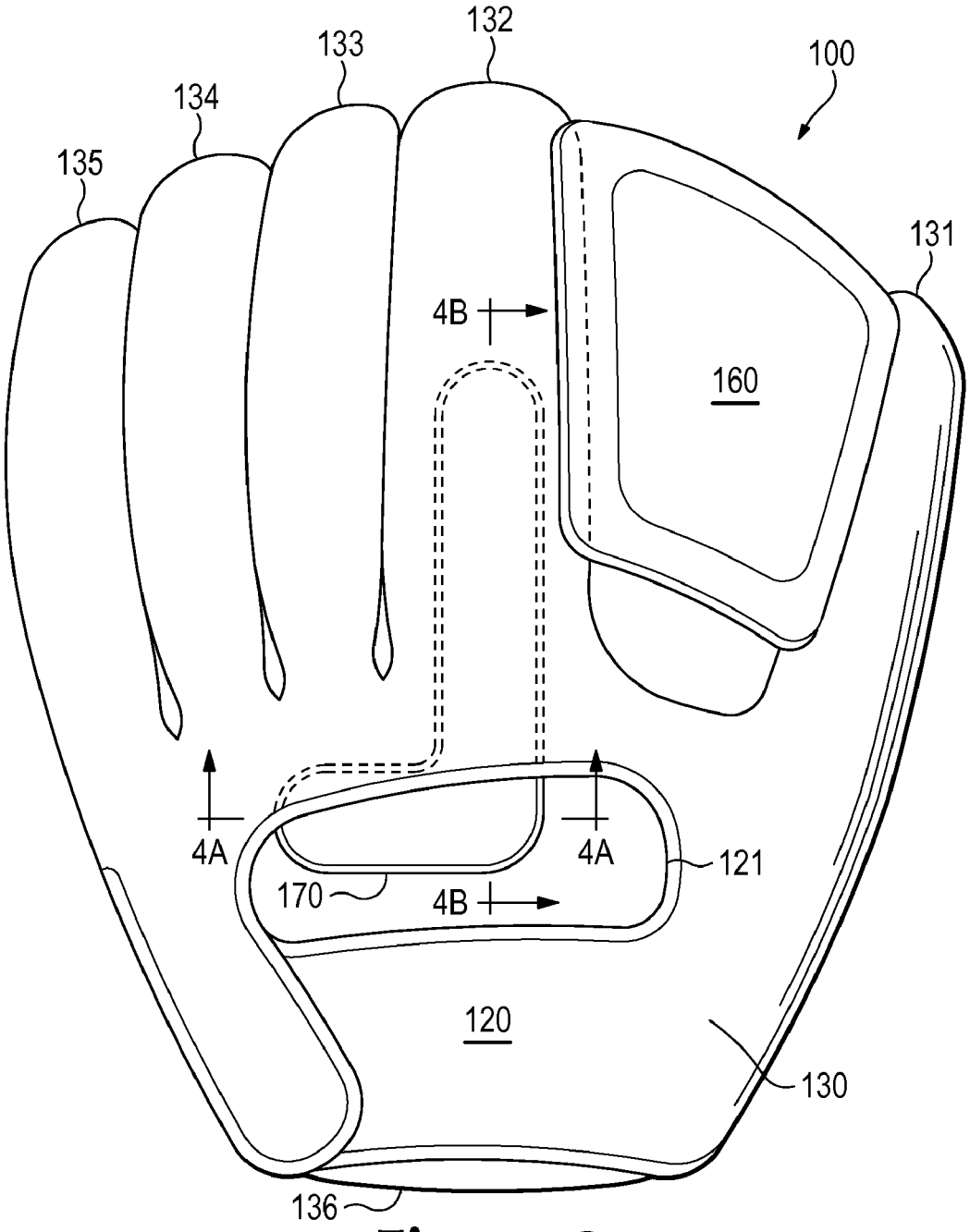
FIG. 2 is an elevational view of a dorsal side of the first ball glove.
Figure 3:
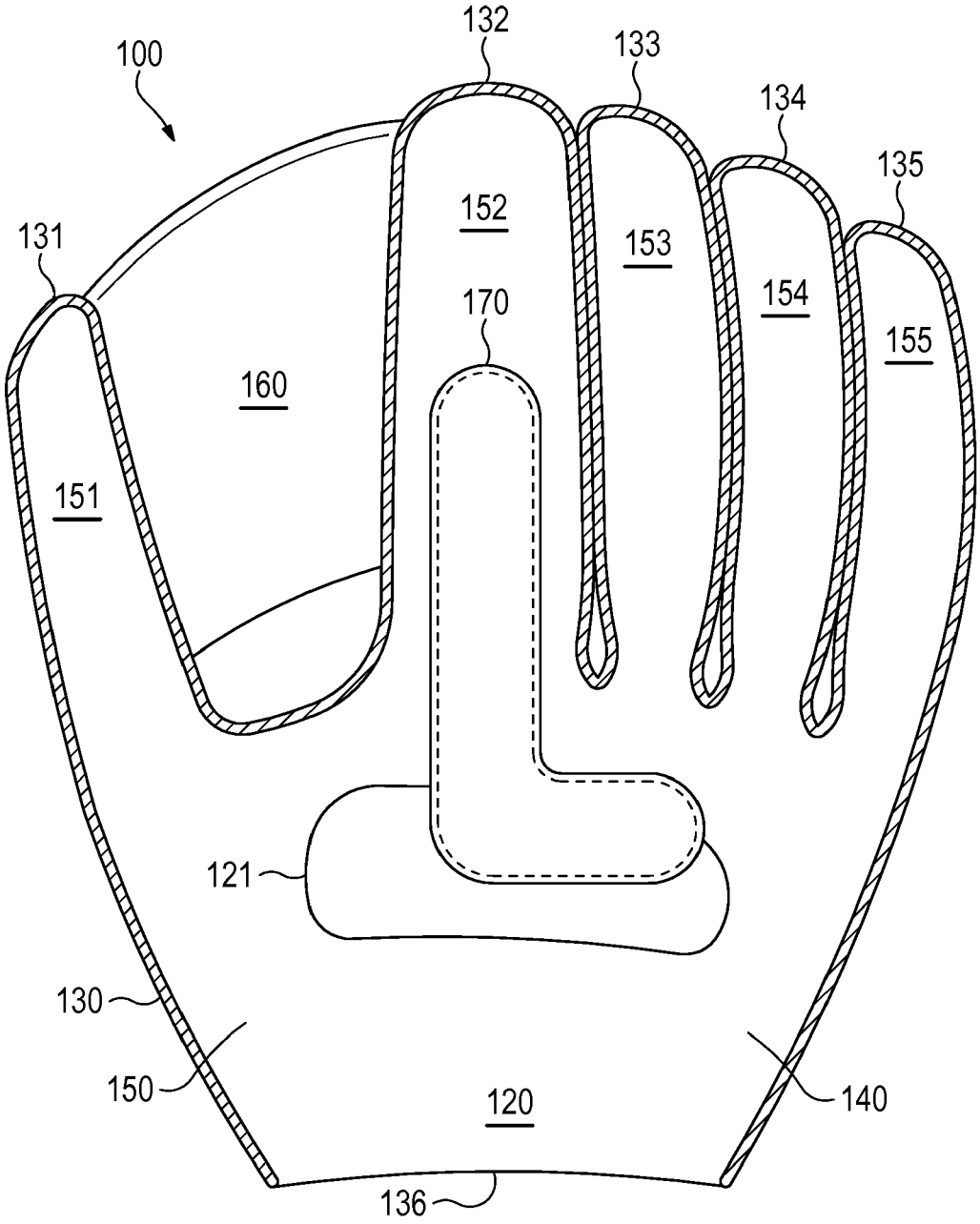
FIG. 3 is a cut-away elevational view of the palmar side of the first ball glove.

The following discussion and accompanying figures disclose various configurations of ball gloves that incorporate force attenuation systems. Although the ball gloves are depicted as having configurations suitable for use in baseball as an outfielder's glove, the concepts disclosed herein may also apply to infielder's gloves, pitcher's gloves, catcher's mitts, or first basemen's mitts, for either baseball or softball, or for similar athletic activities. Moreover, the concepts disclosed herein may apply to a variety of glove styles that facilitate catching balls and protecting a hand from impacts with the balls. While the ball gloves are depicted as having a configuration intended to be used with a left hand of a wearer, it should be understood that the following discussion may also apply to mirror image ball gloves that are intended for use with a right hand of the wearer.

First Ball Glove Configuration

With reference to FIGS. 1 through 4B, an initial configuration of a first ball glove 100 is depicted as including a palmar panel 110, a dorsal panel 120 disposed opposite palmar panel 110, and a webbing 160. Palmar panel 110 and dorsal panel 120 are depicted as having a substantially conventional configuration incorporating a plurality of material elements (e.g., leather, synthetic leather, foam, textile, and rubber elements) that are stitched, laced, or adhesively bonded together to form a hand cavity 140 for receiving a hand of a wearer. Although each of panels 110 and 120 may be formed from a single material element (e.g., leather), panels 110 and 120 may also be formed from multiple, joined material elements. Moreover, each of panels 110 and 120 may have a layered configuration formed from multiple material elements (e.g., leather, foam, and textile).

Palmar panel 110 corresponds to the front or palm side of the hand, whereas dorsal panel 120 corresponds to the back side of the hand. Palmar panel 110 and dorsal panel 120 form a palm region 130, a first finger stall 131, a second finger stall 132, a third finger stall 133, a fourth finger stall 134, and a fifth finger stall 135. Each of finger stalls 132-135 may be laced to, stitched to, or otherwise attached to others of finger stalls 132-135. Palm region 130 generally includes portions of first ball glove 100 corresponding to the palm portion of the hand, including the carpals, the metacarpals, and the joints connecting the metacarpals with the phalanges. Finger stalls 131-135 generally include portions of first ball glove 100 corresponding to the fingers of the hand, including the phalanges and the joints connecting the phalanges. First finger stall 131 corresponds to a thumb of the hand, second finger stall 132 corresponds to an index finger of the hand, third finger stall 133 corresponds to a middle finger of the hand, fourth finger stall 134 corresponds to a ring finger of the hand, and fifth finger stall 135 corresponds to a little finger of the hand. Finger stalls 131-135 may extend beyond the fingers of the hand.

Webbing 160 is positioned between first finger stall 131 and second finger stall 132 and is similarly depicted as having a substantially conventional configuration. Generally, webbing 160 is secured to palmar panel 110, dorsal panel 120, or both, and connects first finger stall 131 to second finger stall 132. Webbing 160 may be either open (i.e., having a plurality of apertures) or closed. In some configurations, webbing 160 may be formed from a plurality of interlaced strips of material, such as leather. Palmar panel 110, dorsal panel 120, and webbing 160 are typically formed to create a pocket for catching a ball, which includes webbing 160.

A wrist opening 136 in palm region 130 provides access to hand cavity 140, which is formed between palmar panel 110 and dorsal panel 120. Hand cavity 140 includes a palm void 150 located within palm region 130 for receiving the palm of the hand, a first finger void 151 located within first finger stall 131 for receiving the thumb of the hand, a second finger void 152 located within second finger stall 132 for receiving the index finger of the hand, a third finger void 153 located within third finger stall 133 for receiving the middle finger of the hand, a fourth finger void 154 located within fourth finger stall 134 for receiving the ring finger of the hand, and a fifth finger void 155 located within fifth finger stall 135 for receiving the little finger of the hand. The palm and the fingers of the hand may not span all the portions of hand cavity 140 to which they correspond. In other words, portions of hand cavity 140 corresponding to the palm and the fingers may extend beyond the palm and the fingers to which they correspond. A dorsal aperture 121 is positioned on dorsal panel 120 between finger stalls 131-135 and wrist opening 136, in at least a location corresponding to an index finger of the hand. Dorsal aperture 121 is positioned, among other things, to permit the index finger to extend from hand cavity 140 within the ball glove to a position on an outer surface of dorsal panel 120 corresponding to the externally-extended index finger.

First ball glove 100 includes a palmar force attenuation system 170, which incorporates one or more chambers. Palmar force attenuation system 170 may enhance a force attenuation characteristic of first ball glove 100 (i.e., provide cushioning), further facilitating the catching of balls and the protection of the hand from pain and discomfort associated with impacts with balls.

Given that various aspects of the present invention relate primarily to palmar force attenuation system 170, other portions of first ball glove 100, including palmar panel 110, dorsal panel 120, and webbing 160, may exhibit the general configuration discussed above or the general configuration of any other ball glove. Accordingly, the structure of first ball glove 100 may vary significantly.

Palmar Force Attenuation System Configuration

Palmar force attenuation system 170 is located within first ball glove 100 to protect portions of a palm side of the hand. As discussed in greater detail below, palmar force attenuation system 170 has the configuration of a fluid-filled chamber. In this configuration, palmar force attenuation system 170 effectively attenuates impact forces or otherwise cushions impacts from balls being caught with first ball glove 100. Although palmar force attenuation system 170 may only enclose a fluid (e.g., gas or liquid), some configurations of palmar force attenuation system 170 enclose a foam structure that further attenuates impact forces or otherwise cushions impacts from balls being caught with first ball glove 100.

Figure 4A:
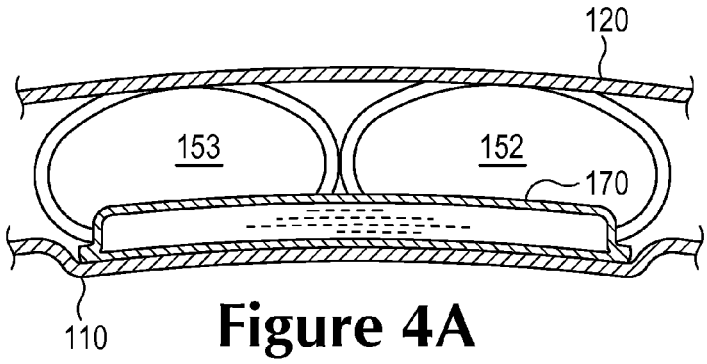
FIGS. 4A and 4B are cross-sectional views of the first ball glove, as respectively defined by section lines 4A and 4B in FIG. 2.
Figure 4B:
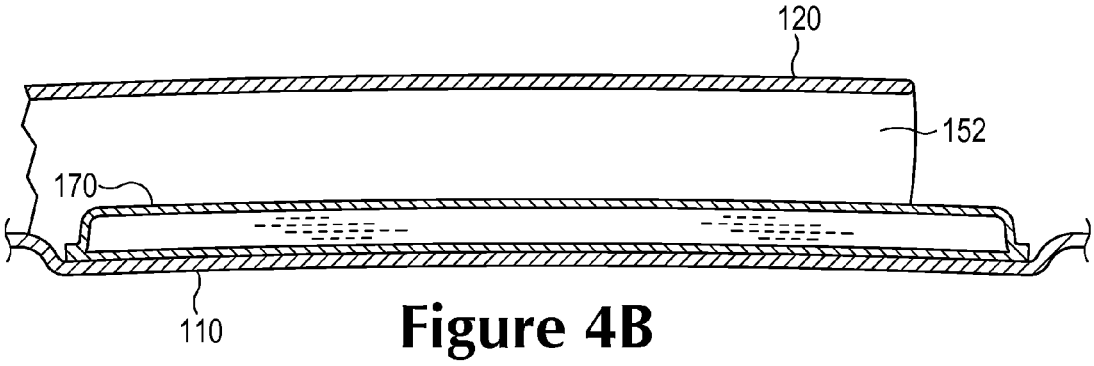
Figure 5:
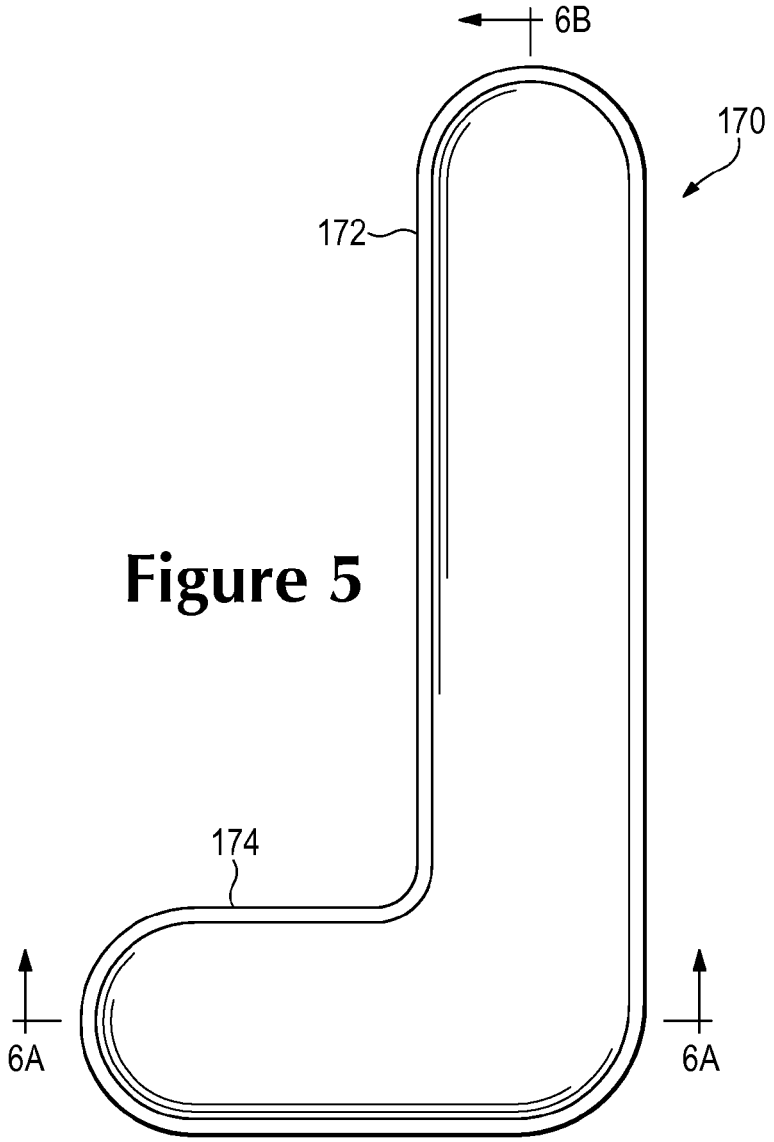
FIG. 5 is a top plan view of a palmar force attenuation system of the first ball glove.
Figure 6A:
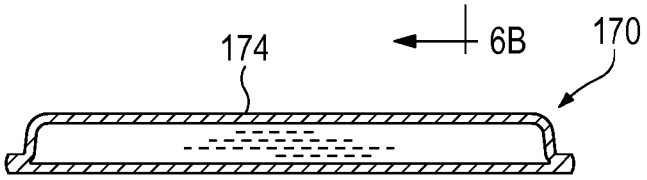
FIGS. 6A and 6B are cross-sectional views of the palmar force attenuation system, as respectively defined by section lines 6A and 6B in FIG. 5.
Figure 6B:
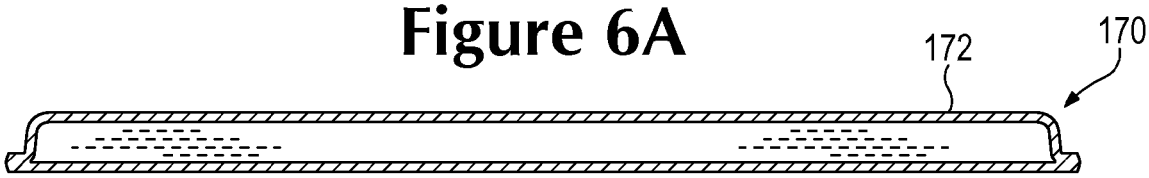

When incorporated into first ball glove 100, palmar force attenuation system 170 may be secured to palmar panel 110 and positioned between a front surface of palmar panel 110 on one side and portions of hand cavity 140 on the other side, as depicted in FIGS. 4A and 4B. In this position, palmar force attenuation system 170 is located to extend between the hand and portions of palmar panel 110 where balls often impact first ball glove 100.

Palmar force attenuation system 170 exhibits a generally L-shaped configuration, having a finger portion 172 corresponding to portions of an index finger and a joint portion 174 corresponding to portions of metacarpophalangeal joints. Finger portion 172 of palmar force attenuation system 170 corresponds to the full length of an index finger, i.e., a length of an index finger including the proximal phalanx, the proximal interphalangeal joint, the intermediate phalanx, the distal interphalangeal joint, and the distal phalanx. Joint portion 174 corresponds to the index finger metacarpophalangeal joint and the middle finger metacarpophalangeal joint.

A majority of palmar force attenuation system 170 is positioned between a front surface of first ball glove 100 and parts of hand cavity 140 including second finger void 152 and the portions of palm void 150 adjacent to second finger void 152 and third finger void 153. Impact from a ball caught within the pocket of first ball glove 100 may apply a force to the hand, such as areas of the hand including the index finger, the index finger metacarpophalangeal joint, and the middle finger metacarpophalangeal joint. Ball players may experience discomfort or soreness due to repeated impacts from caught balls. Accordingly, palmar force attenuation system 170 is located in first ball glove 100 to cover the index finger and the index finger and middle finger metacarpophalangeal joints to protect those areas from impacts due to catching balls. Although palmar force attenuation system 170 may extend to cover other areas of the hand, a majority of palmar force attenuation system 170 is located to cover the index finger and the index and middle finger metacarpophalangeal joints to enhance flexibility and tactile sensation in other areas of the hand.

With reference to FIGS. 4A through 6B, in the initial configuration of first ball glove 100, palmar force attenuation system 170 is a chamber that is sealed to enclose a fluid and may be formed of a polymer material. A wide range of polymer materials that are suitable for containing fluids, particularly when pressurized, may be utilized to form palmar force attenuation system 170. In selecting a polymer material for palmar force attenuation system 170, engineering properties of the material (e.g., tensile strength, stretch properties, and fatigue characteristics) may be considered, as well as the ability of the material to prevent diffusion of the fluid located within palmar force attenuation system 170. Examples of suitable polymer materials include thermoplastic polyurethane, polyester, polyester polyurethane, and polyether polyurethane. Palmar force attenuation system 170 may also be formed from a material that includes alternating layers of thermoplastic polyurethane and ethylene-vinyl alcohol copolymer, as disclosed in U.S. Pat. Nos. 5,713,141 and 5,952,065 to Mitchell, et al. Another suitable material for palmar force attenuation system 170 is a flexible microlayer membrane that includes alternating layers of a gas barrier material and an elastomeric material, as disclosed in U.S. Pat. Nos. 6,082,025 and 6,127,026 to Bonk, et al. Additional suitable materials are disclosed in U.S. Pat. Nos. 4,183,156 and 4,219,945 to Rudy. Further suitable materials include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340; 6,203,868; and 6,321,465 to Bonk, et al. A variety of molding processes may be suitable for forming palmar force attenuation system 170, including blowmolding, rotational molding, two-film techniques, or thermoforming.

A variety of fluids may be enclosed within palmar force attenuation system 170, including both gasses and liquids. In some configurations, gel materials may also be enclosed within palmar force attenuation system 170. With regard to gasses, palmar force attenuation system 170 may enclose air, nitrogen, octafluorapropane, or any of the gasses disclosed in U.S. Pat. No. 4,340,626 to Rudy, such as hexafluoroethane and sulfur hexafluoride. As an example, the fluid within palmar force attenuation system 170 may be pressurized between zero and three-hundred fifty kilopascals (i.e., approximately fifty-one pounds per square inch) or more.

Based upon the above discussion, palmar force attenuation system 170 is incorporated into first ball glove 100 adjacent to palmar panel 110 in areas corresponding to the index finger and the index and middle finger metacarpophalangeal joints, in order to protect the hand from impact forces due to catching balls.

Further Configurations

The above discussion of first ball glove 100 and palmar force attenuation system 170 provides examples of suitable configurations. As discussed below, however, both first ball glove 100 and palmar force attenuation system 170 may exhibit a variety of other configurations.

In the initial configuration of first ball glove 100, finger stalls 132-135 correspond to an index finger, a middle finger, a ring finger, and a little finger of the hand, and finger voids 152-155 for receiving the index finger, the middle finger, the ring finger, and the little finger are respectively located within finger stalls 132-135. In alternate configurations, one or more of finger stalls 132-135 may be replaced with a single finger stall that corresponds to more than one of the index finger, the middle finger, the ring finger, and the little finger of the hand. In such cases, each of finger voids 152-155 still exists, but may be located within a different finger stall than in the original configuration of first ball glove 100. For example, in an alternate configuration of first ball glove 100, in which first ball glove 100 is a mitt, finger stall 132 may correspond to the index finger, the middle finger, the ring finger, and the little finger of the hand, and finger voids 152-155 for receiving the index finger, the middle finger, the ring finger, and the little finger are all located within finger stall 132.

Figure 7A:
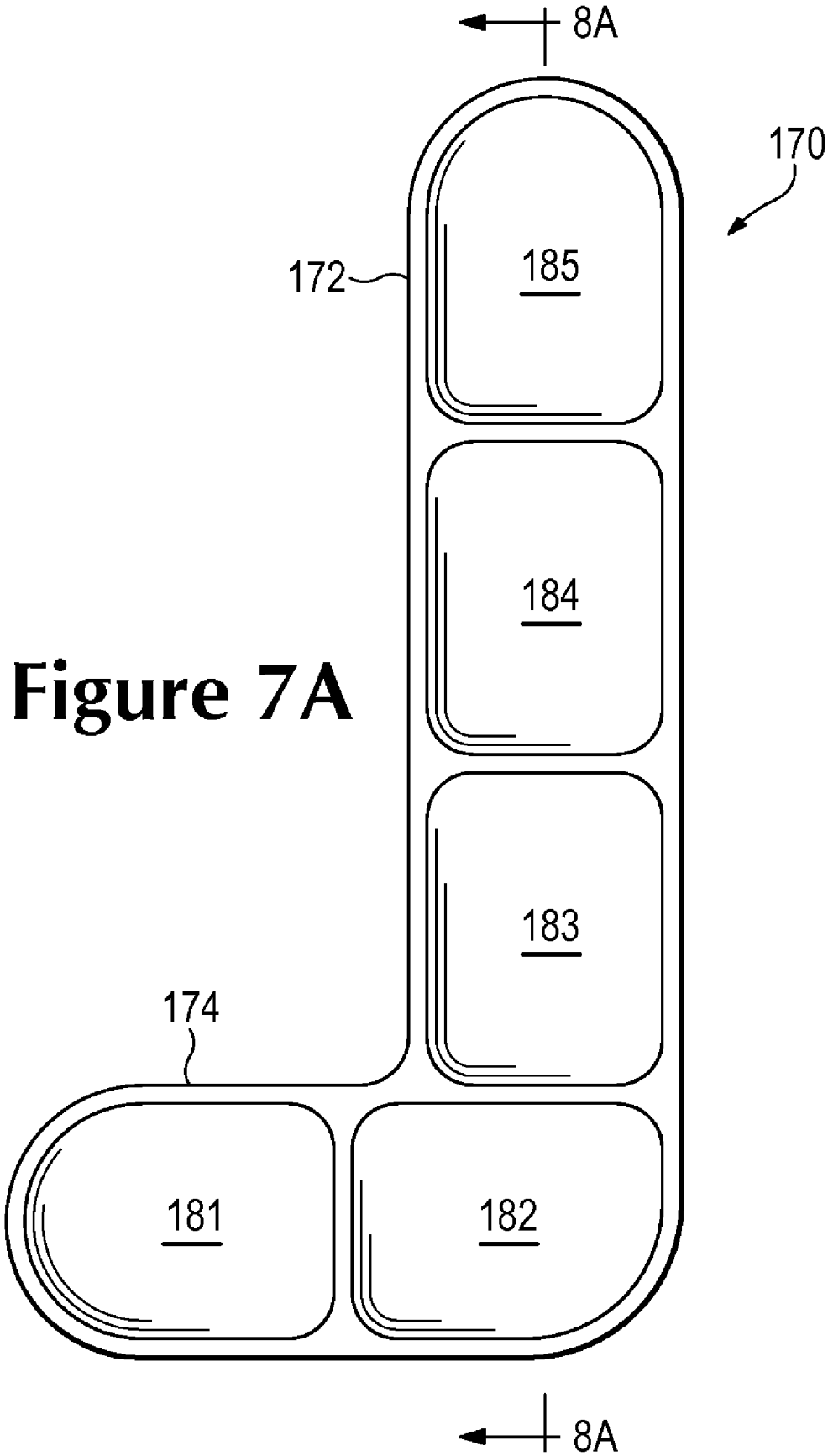
FIGS. 7A-7F are top plan views of further configurations of the palmar force attenuation system.
Figure 7B:
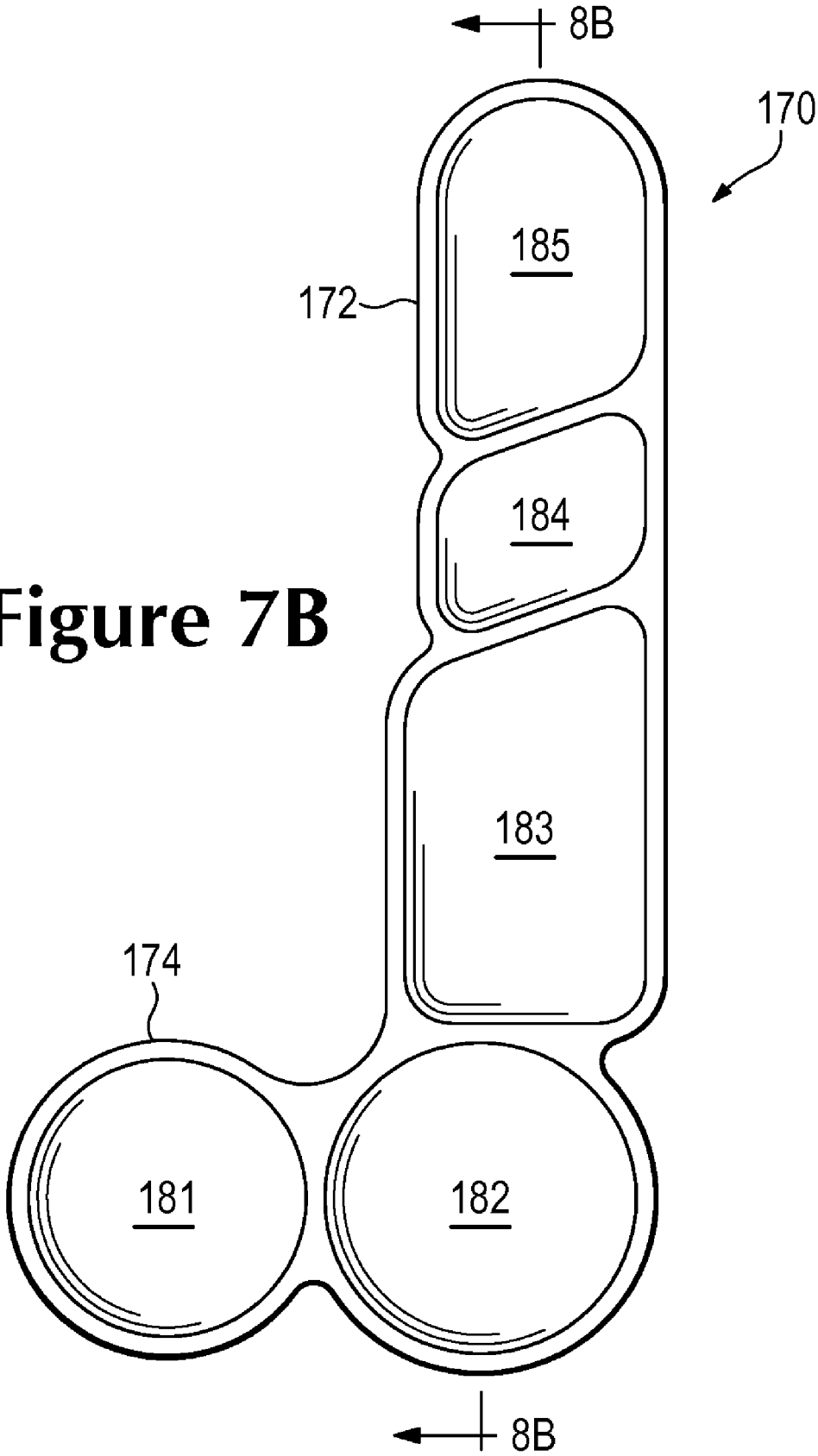
Figure 8A:
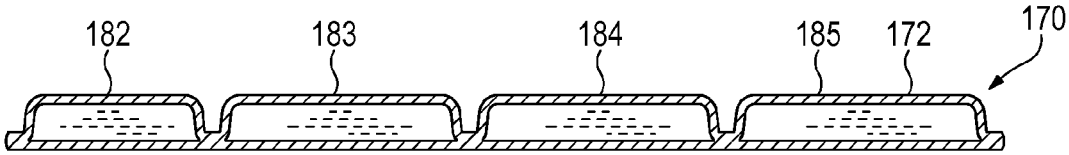
FIGS. 8A-8F are cross-sectional views of the further configurations of the palmar force attenuation system, as respectively defined by section lines 8A-8F in FIGS. 7A-7F.
Figure 8B:
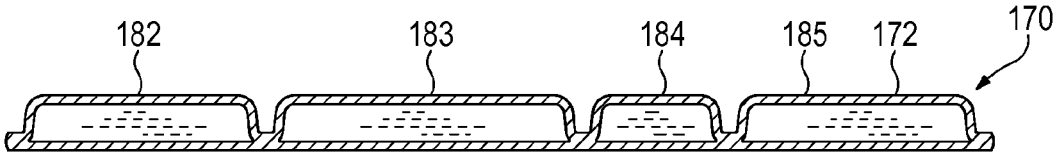

In the initial configuration of first ball glove 100, palmar force attenuation system 170 is a single chamber that is sealed to enclose a fluid, which may be pressurized. In alternate configurations, palmar force attenuation system 170 may include a plurality of chambers, each of which may either be in fluid communication with other chambers or isolated from fluid communication with each other. For example, with reference to FIGS. 7A and 8A, palmar force attenuation system 170 may include a plurality of chambers 181-185 that are located to protect specific areas of the hand. More particularly, chamber 181 corresponds to a middle finger metacarpophalangeal joint, chamber 182 corresponds to an index finger metacarpophalangeal joint, chamber 183 corresponds to an index finger proximal phalanx, chamber 184 corresponds to an index finger intermediate phalanx, and chamber 185 corresponds to an index finger distal phalanx. Chambers 181-185 may be substantially rectangular. In other alternate configurations, each of a plurality of chambers may have its own shape, being generally square, circular, oval, triangular, for example, or may have any geometric or irregular shape. For example, with reference to FIGS. 7B and 8B, chambers 181-182 may be substantially circular and chambers 183-185 may have substantially the shape of four-sided polygons.

In the initial configuration of first ball glove 100, finger portion 172 of palmar force attenuation system 170 corresponds to the full length of an index finger, and joint portion 174 corresponds to the index finger metacarpophalangeal joint and the middle finger metacarpophalangeal joint. In alternate configurations, finger portion 172 may correspond to less than the length of an index finger, or may extend beyond the length of an index finger. For example, in one alternate configuration, finger portion 172 may correspond to an alternate length of an index finger including only the proximal phalanx, the proximal interphalangeal joint, and the intermediate phalanx, and joint portion 174 of palmer force attenuation system 170 may correspond to an index finger metacarpophalangeal joint and a middle finger metacarpophalangeal joint. Similarly, in other alternate configurations, joint portion 174 may correspond to additional portions of a wearer's hand. For example, in one alternate configuration, joint portion 174 may correspond to portions of a ring finger metacarpophalangeal joint and a little finger metacarpophalangeal joint. In further alternate configurations, joint portion 174 may correspond to portions of associated metacarpals and phalanges, such as index finger and middle finger metacarpals and phalanges. In additional alternate configurations, palmar force attenuation system 170 may correspond to any contiguous area of hand cavity 140.

Figure 7C:
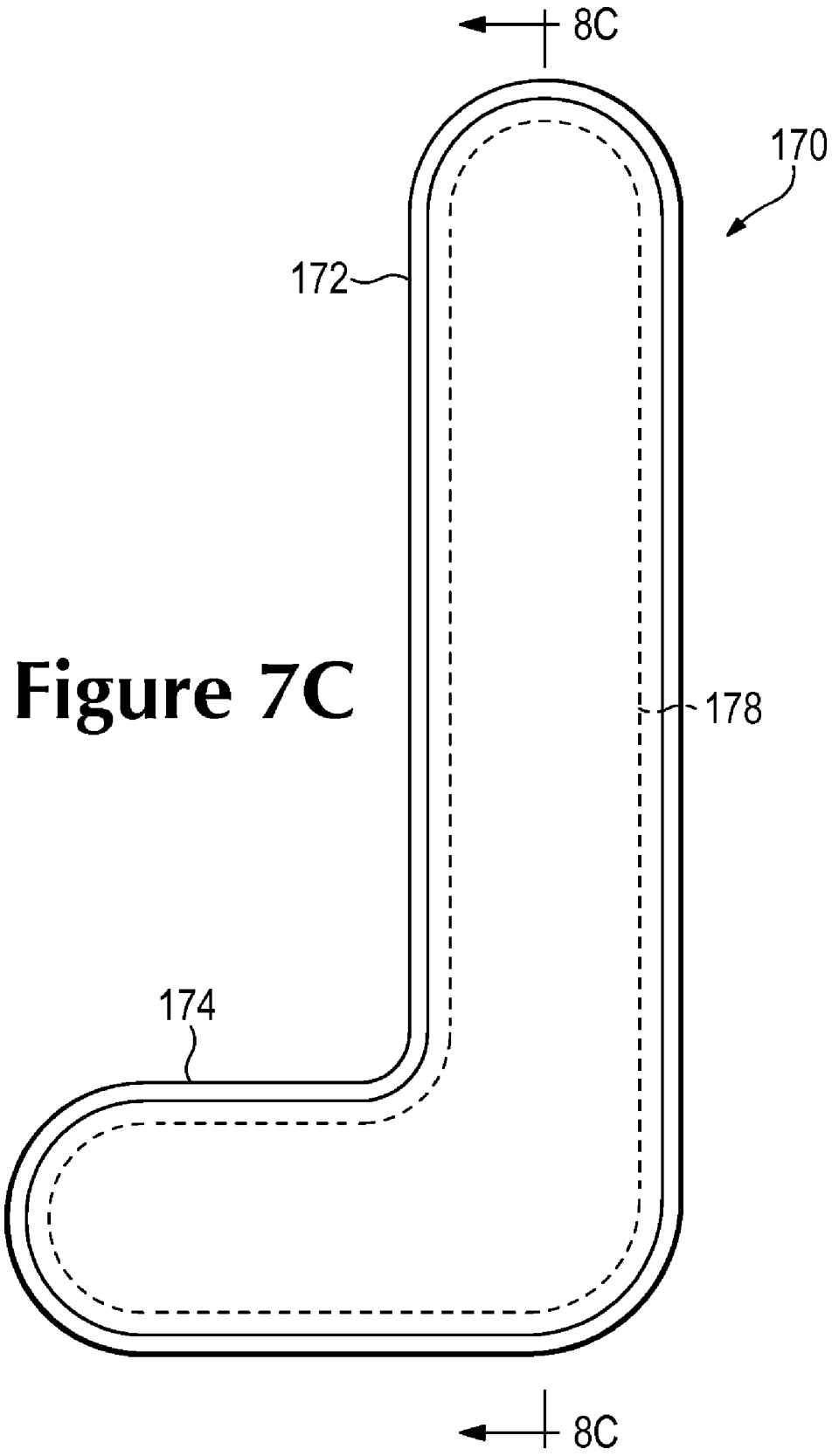
Figure 7D:
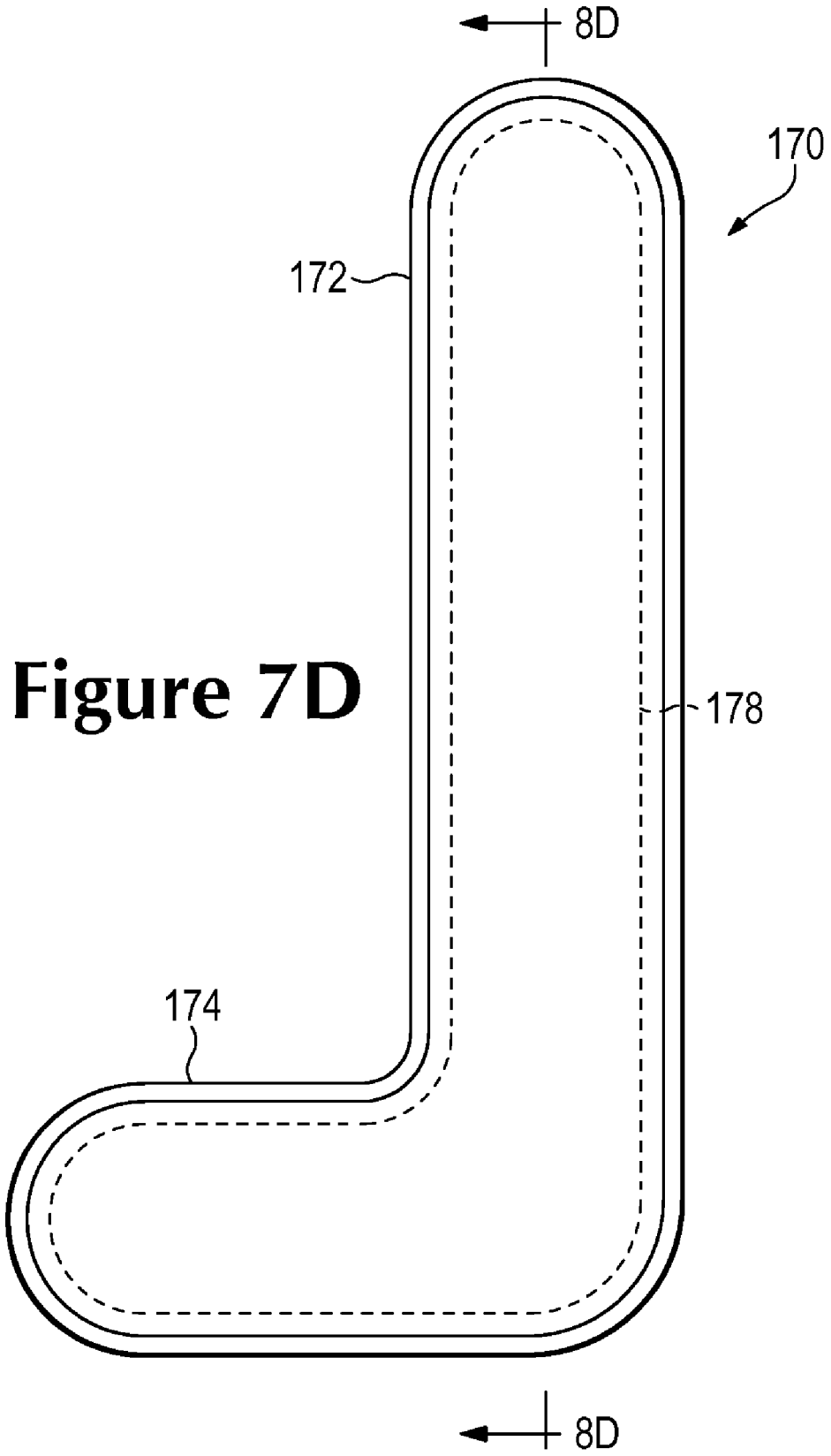
Figure 7E:
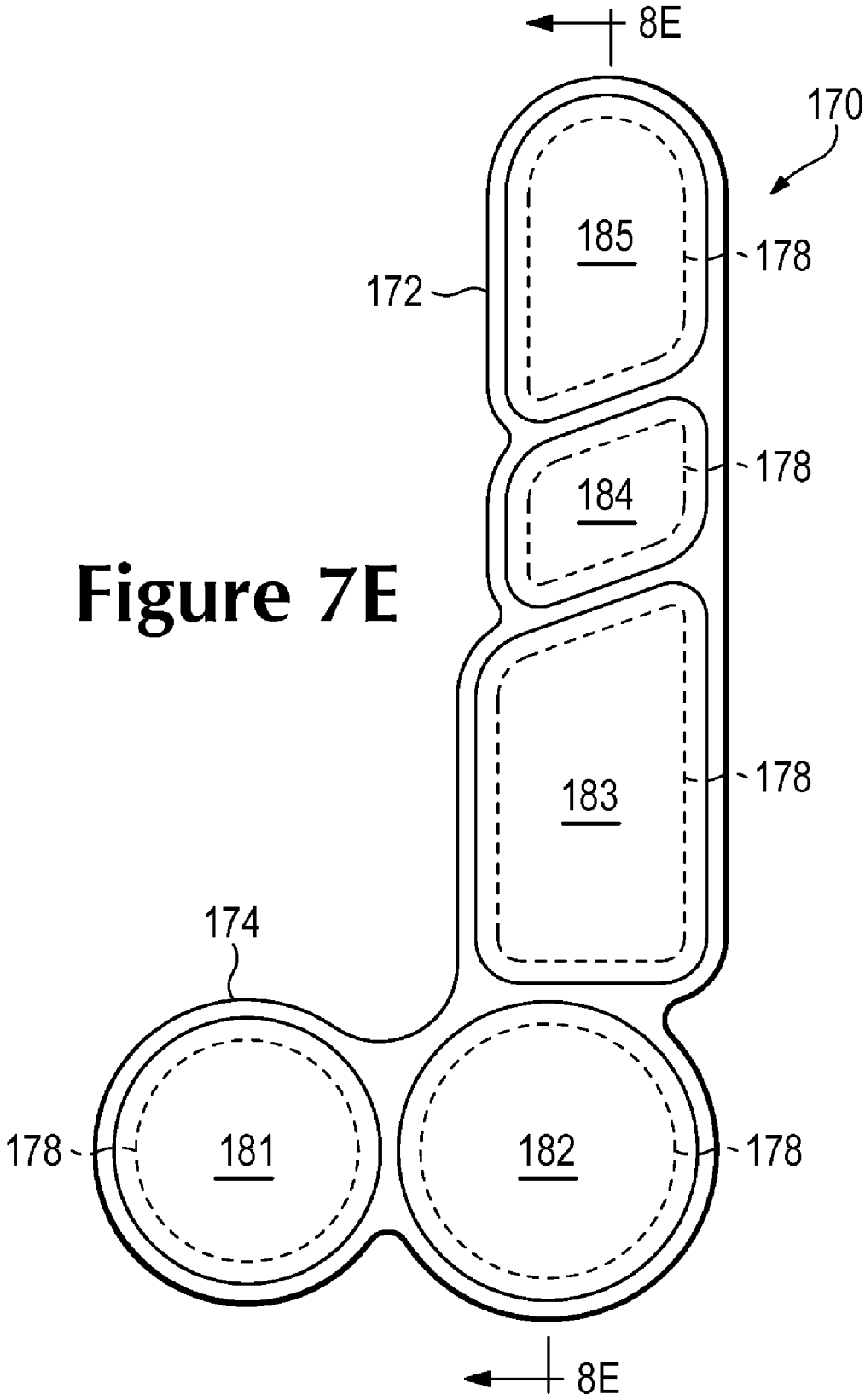
Figure 7F:
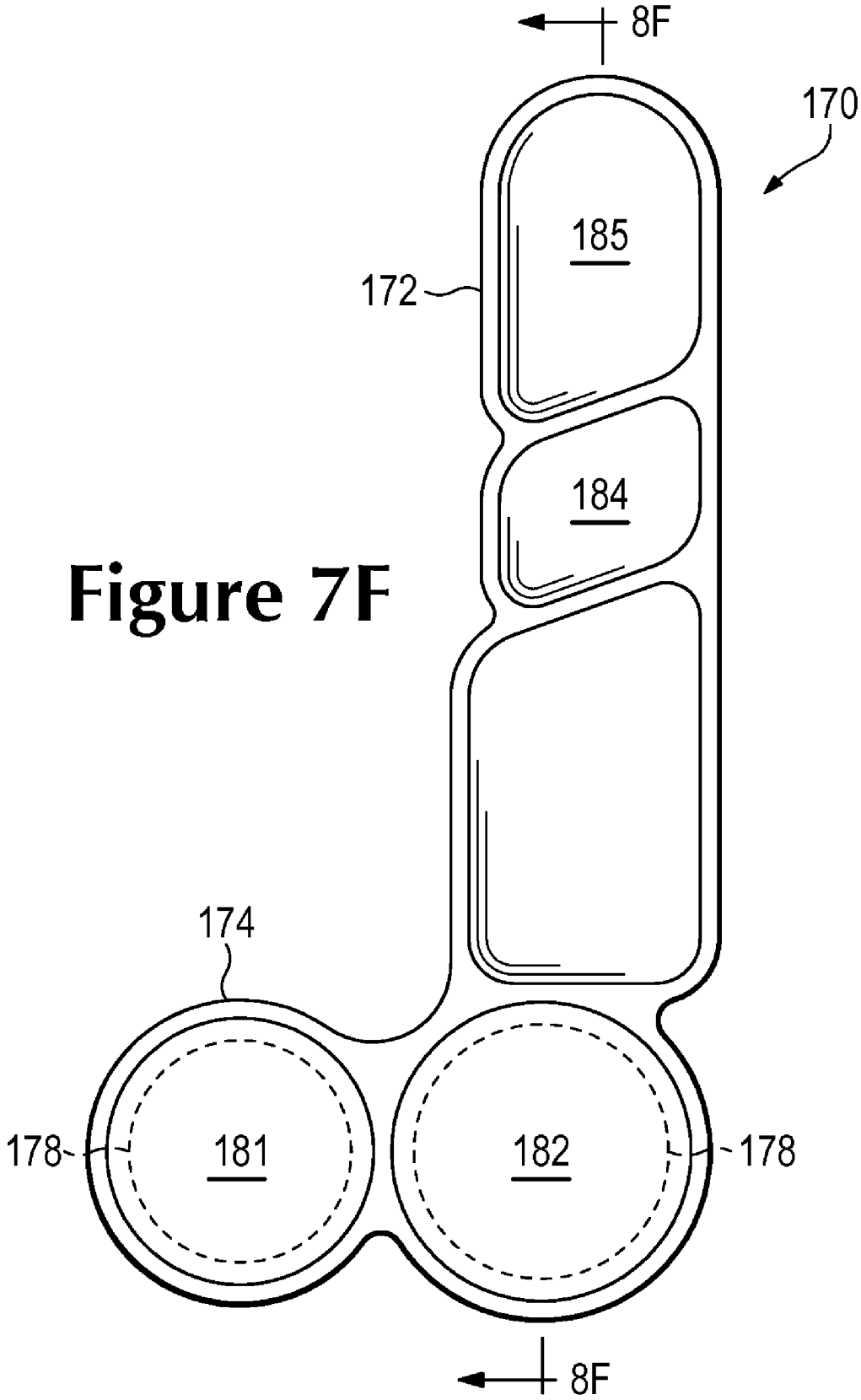
Figure 8C:
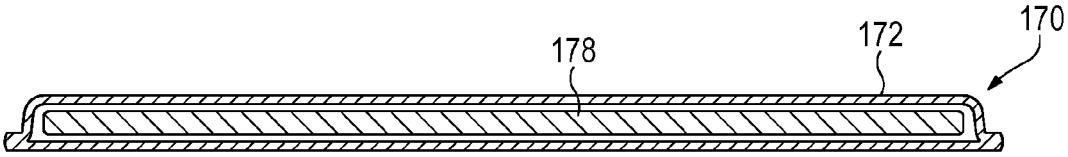
Figure 8D:
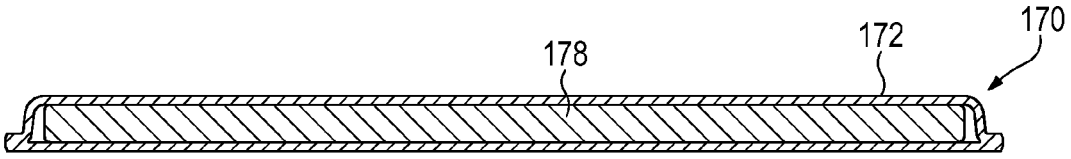
Figure 8E:
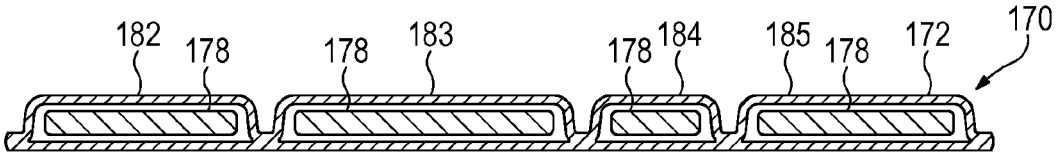
Figure 8F:
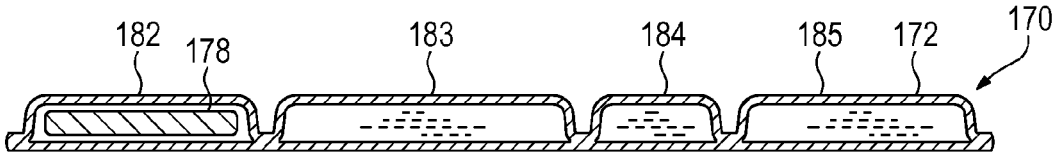

In some configurations of palmar force attenuation system 170, foam structures or other elements may be located within the chamber. That is, the chamber formed by palmar force attenuation system 170 may be sealed to enclose a variety of elements. Referring to FIGS. 7C and 8C, for example, palmar force attenuation system 170 encloses a foam structure 178, which may be any foam, including a basic foam, a slow recovery foam, or a microcellular polyurethane foam such as PORON, a product of the Rogers Corporation of Rogers, Conn. Foam structure 178 fills a majority of the chamber within palmar force attenuation system 170 and is unbonded to upper and lower internal surfaces of palmar force attenuation system 170. In another configuration, depicted in FIGS. 7D and 8D, foam structure 178 is bonded to the upper and lower internal surfaces of palmar force attenuation system 170. In further configurations, multiple foam structures 178 may be located within individual chambers 181-185, as depicted in FIGS. 7E and 8E. Furthermore, only some of chambers 181-185 may enclose foam structures 178. Referring to FIGS. 7F and 8F, foam structures 178 are located in chambers 181 and 182, but are absent from chambers 183-185.

Although one or more foam structures or other elements may be present within palmar force attenuation system 170, a fluid may also be located within palmar force attenuation system 170. When palmar force attenuation system 170 encloses a foam structure, palmar force attenuation system 170 may still contain a fluid. Accordingly, palmar force attenuation systems 170 enclosing foam structures 178 may also be fluid-filled chambers.

Figure 9A:
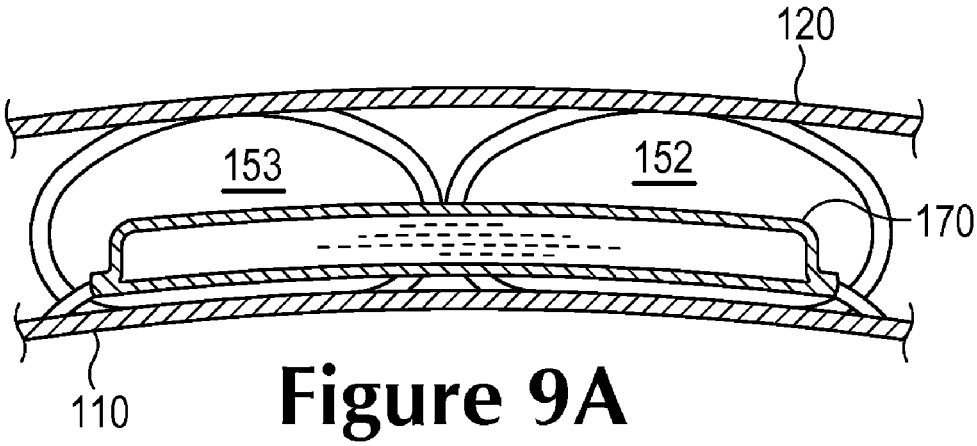
FIGS. 9A-9C are cross-sectional views corresponding with FIG. 4A and depicting further configurations of the first ball glove.

In the initial configuration of first ball glove 100, palmar force attenuation system 170 is secured to an inner surface of palmar panel 110. In alternate configurations, palmar force attenuation system 170 may be otherwise secured to one or more of palmar panel 110, a seam joining panels 110 and 120, and dorsal panel 120 within first ball glove 100 in a position between hand cavity 140 and palmar panel 110. For example, with reference to FIG. 9A, palmar force attenuation system 170 may be secured to stitches, laces, or bonding material and thereby suspended proximally to, but not secured to, palmar panel 110. In other alternate configurations, palmer force attenuation system 170 may be partially secured to palmar panel 110, and partially otherwise secured in a position between hand cavity 140 and palmar panel 110.

Figure 9B:
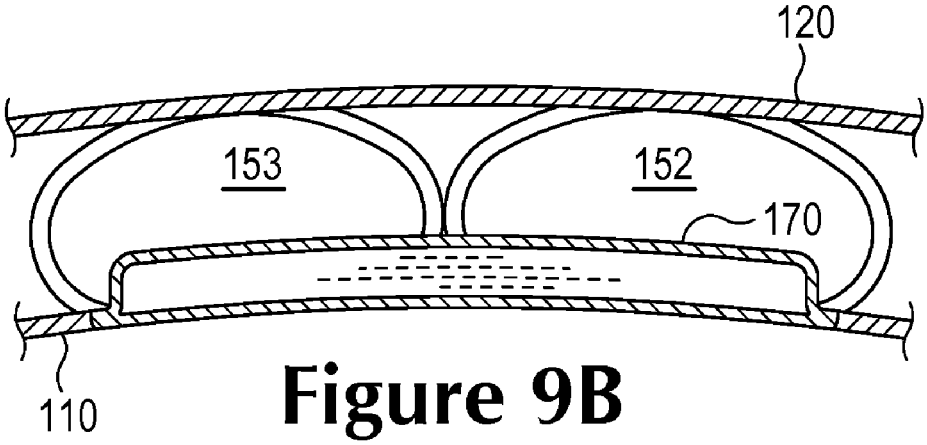

In the initial configuration of first ball glove 100, palmar force attenuation system 170 is secured to an inner surface of palmar panel 110. In alternate configurations, palmar force attenuation system 170 may be integrally secured to and within palmar panel 110, being secured within recesses in an inner surface of palmar panel 110, or within apertures extending from an inner surface of palmar panel 110 to an outer surface of palmar panel 110. For example, with reference to FIG. 9B, portions of force attenuation system 170 are secured within an aperture extending through palmar panel 110, such portions being substantially flush with and comprising part of a continuous outer surface of palmar panel 110.

Figure 9C:
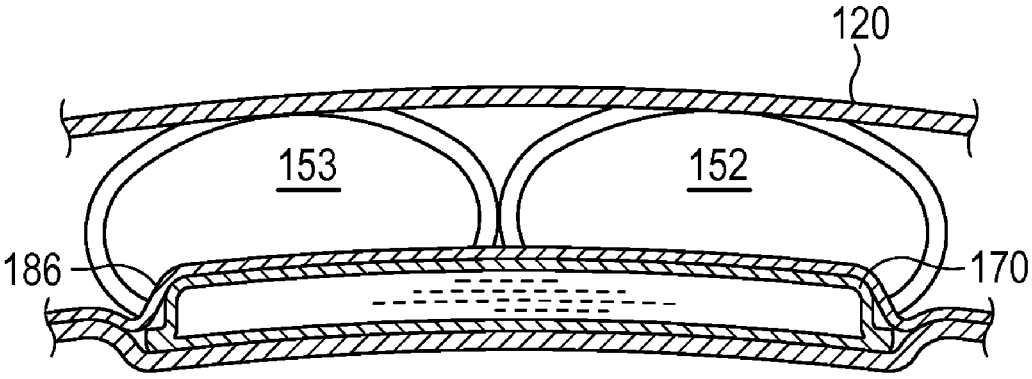
Figure 10:
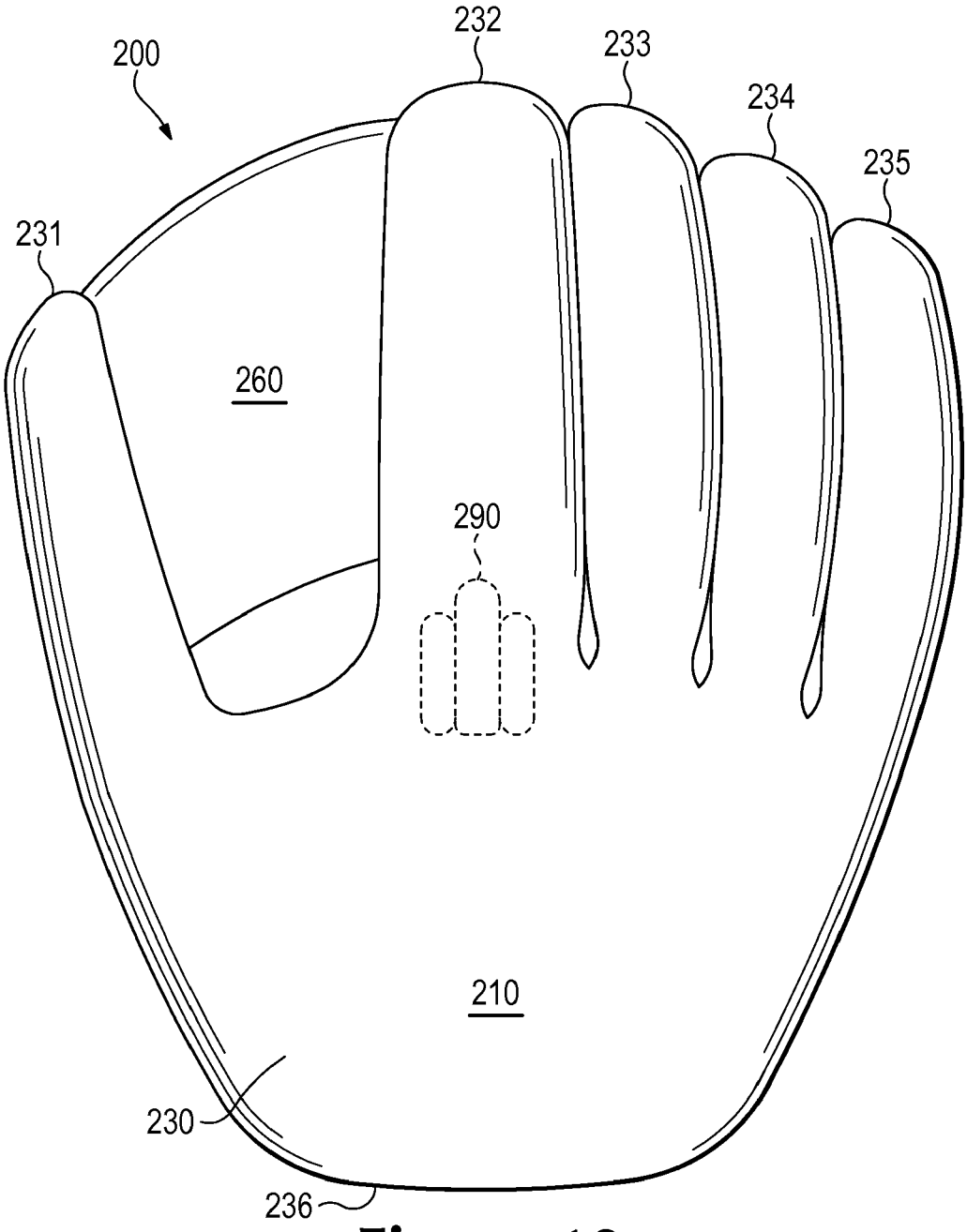
FIG. 10 is an elevational view of a palmar side of a second ball glove.
Figure 11:
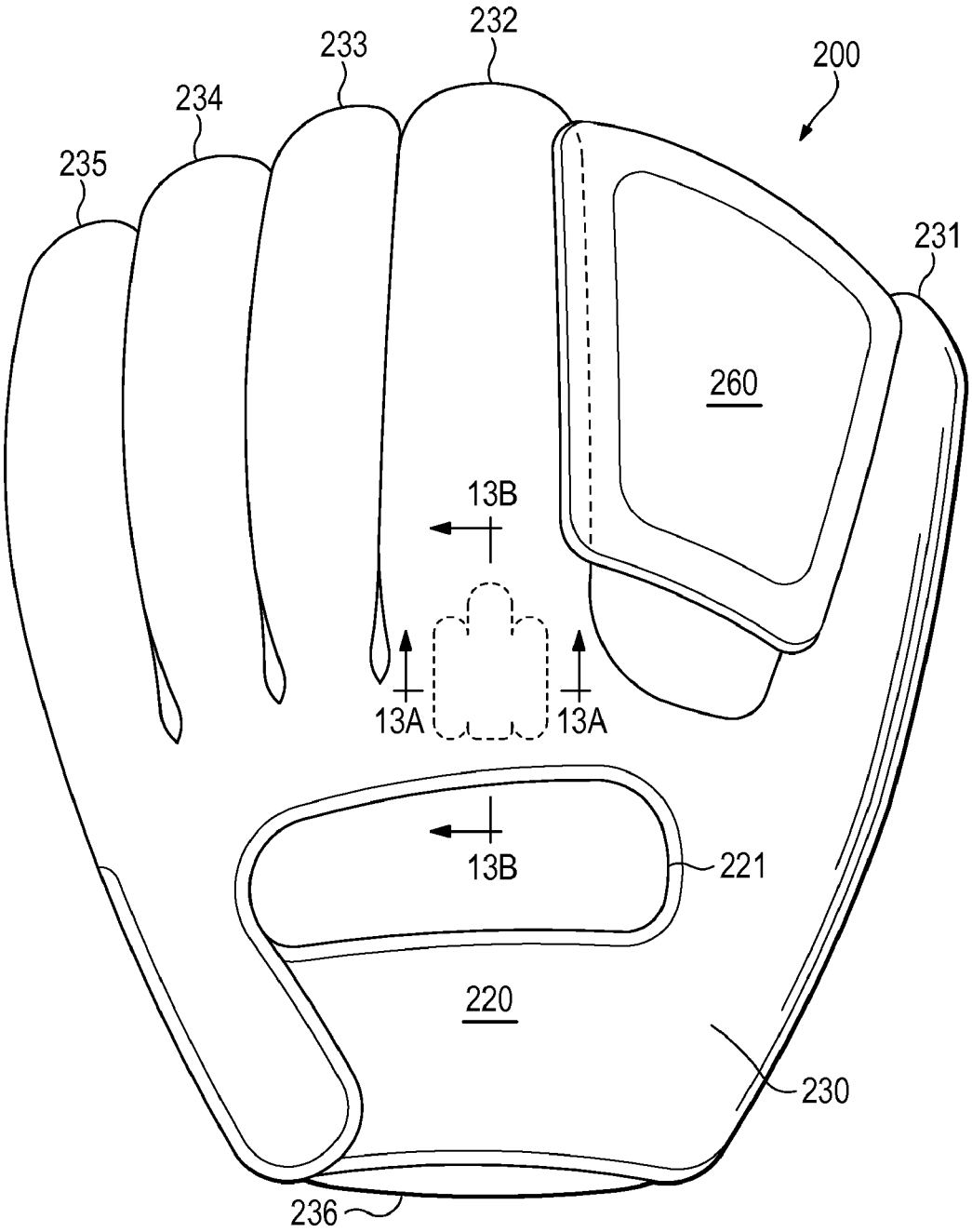
FIG. 11 is an elevational view of a dorsal side of the second ball glove.
Figure 12:
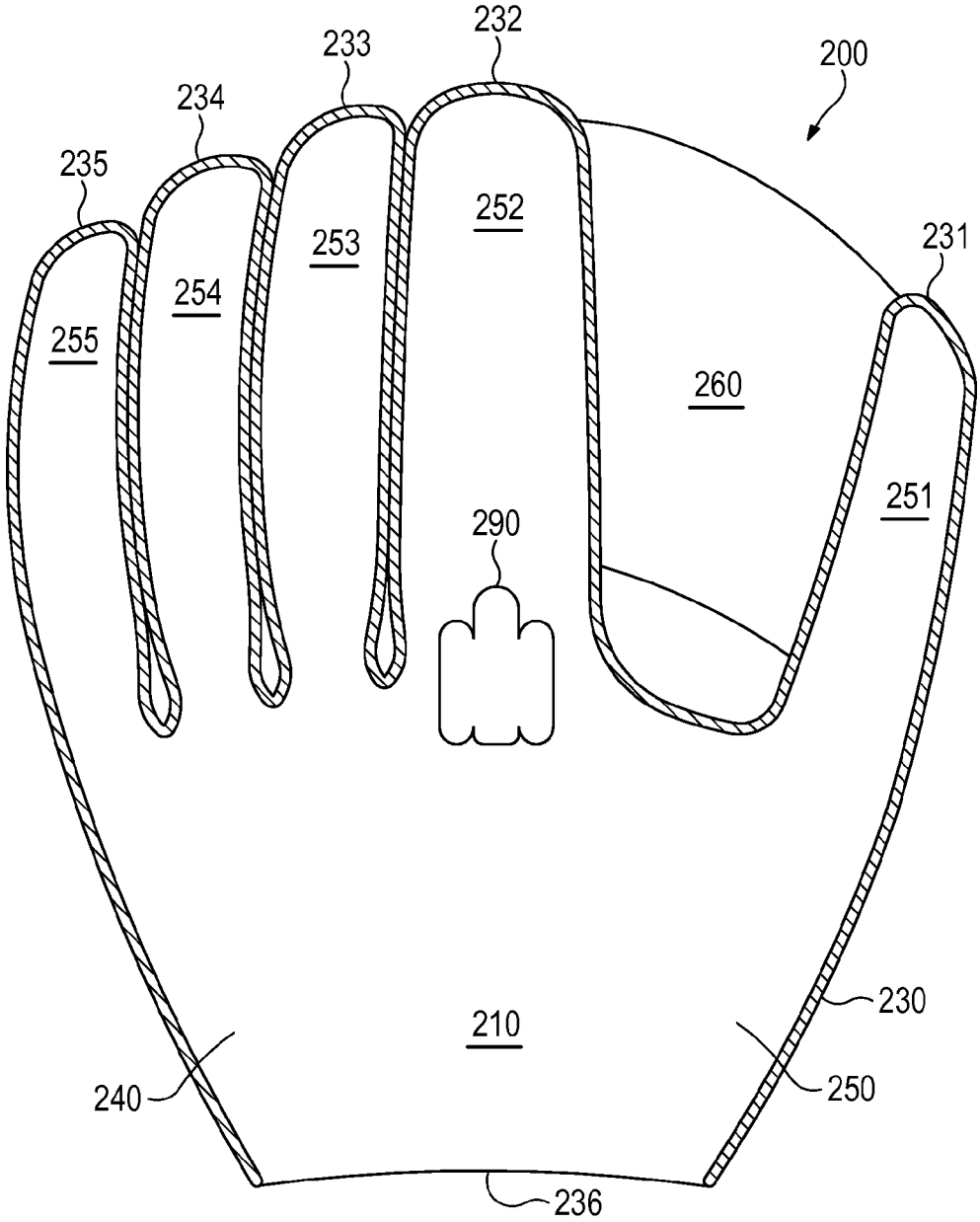
FIG. 12 is a cut-away elevational view of the dorsal side of the second ball glove.

In the initial configuration of first ball glove 100, a hand within hand cavity 140 may directly contact a surface of palmar force attenuation system 170. In alternate configurations, as depicted in FIG. 9C, another layer 186 of palmar panel 110 may extend over palmar force attenuation system 170. In these configurations, the hand within hand cavity 140 may contact layer 186 rather than the surface of palmar force attenuation system 170

In summary, first ball glove 100 may have a configuration suitable for use as a mitt or any other type of ball glove, and may include another layer adjacent to hand cavity 140 extending over palmar force attenuation system 170. Additionally, palmar force attenuation system 170 may have various numbers of chambers of various shapes, any chamber of which may enclose a foam structure which may or may not be secured to an inner surface of the chamber. Palmar force attenuation system 170 may be secured to an inner surface of palmar panel 110, or secured in a position between hand cavity 140 and palmar panel 110, or located in apertures in palmar panel 110.

Second Ball Glove Configuration

With reference to FIGS. 10 through 13B, an initial configuration of a second ball glove 200 is depicted as including a palmar panel 210, a dorsal panel 220 disposed opposite palmar panel 210, and a webbing 260. Palmar panel 210 and dorsal panel 220 are depicted as having a substantially conventional configuration incorporating a plurality of material elements (e.g., leather, synthetic leather, foam, textile, and rubber elements) that are stitched, laced, or adhesively bonded together to form a hand cavity 240 for receiving a hand of a wearer. Although each of panels 210 and 220 may be formed from a single material element (e.g., leather), panels 210 and 220 may also be formed from multiple, joined material elements. Moreover, each of panels 210 and 220 may have a layered configuration formed from multiple material elements (e.g., leather, foam, and textile).

Palmar panel 210 corresponds to the front or palm side of the hand, whereas dorsal panel 220 corresponds to the back side of the hand. Palmar panel 210 and dorsal panel 220 form a palm region 230, a first finger stall 231, a second finger stall 232, a third finger stall 233, a fourth finger stall 234, and a fifth finger stall 235. Each of finger stalls 232-235 may be laced to, stitched to, or otherwise attached to others of finger stalls 232-235. Palm region 230 generally includes portions of second ball glove 200 corresponding to the palm portion of the hand, including the carpals, the metacarpals, and the joints connecting the metacarpals with the phalanges. Finger stalls 231-235 generally include portions of second ball glove 200 corresponding to the fingers of the hand, including the joints connecting the metacarpals with the phalanges, the phalanges, and the joints connecting the phalanges. First finger stall 231 corresponds to a thumb of the hand, second finger stall 232 corresponds to an index finger of the hand, third finger stall 233 corresponds to a middle finger of the hand, fourth finger stall 234 corresponds to a ring finger of the hand, and fifth finger stall 235 corresponds to a little finger of the hand. Finger stalls 231-235 may extend beyond the fingers of the hand.

Webbing 260 is positioned between first finger stall 231 and second finger stall 232 and is similarly depicted as having a substantially conventional configuration. Generally, webbing 260 is secured to palmar panel 210, dorsal panel 220, or both, and connects first finger stall 231 to second finger stall 232. Webbing 260 may be either open (i.e., having a plurality of apertures) or closed. In some configurations, webbing 260 may be formed from a plurality of interlaced strips of material, such as leather. Palmar panel 210, dorsal panel 220, and webbing 260 are typically formed to create a pocket for catching a ball.

A wrist opening 236 in palm region 230 provides access to hand cavity 240, which is formed between palmar panel 210 and dorsal panel 220. Hand cavity 240 includes a palm void 250 located within palm region 230 for receiving the palm of the hand, a first finger void 251 located within first finger stall 231 for receiving the thumb of the hand, a second finger void 252 located within second finger stall 232 for receiving the index finger of the hand, a third finger void 253 located within third finger stall 233 for receiving the middle finger of the hand, a fourth finger void 254 located within fourth finger stall 234 for receiving the ring finger of the hand, and a fifth finger void 255 located within fifth finger stall 235 for receiving the little finger of the hand. The palm and the fingers of the hand may not span all the portions of hand cavity 240 to which they correspond. In other words, portions of hand cavity 240 corresponding to the palm and the fingers may extend beyond the palm and the fingers to which they correspond. A dorsal aperture 221 is positioned on dorsal panel 220 between finger stalls 231-235 and wrist opening 236, in at least a location corresponding to an index finger of the hand. Dorsal aperture 221 is positioned, among other things, to permit the index finger to extend from hand cavity 240 within the ball glove to a position on an outer surface of dorsal panel 220 corresponding to the externally-extended index finger.

Second ball glove 200 includes a dorsal force attenuation system 290, which incorporates one or more chambers. Dorsal force attenuation system 290 may enhance a force attenuation characteristic of second ball glove 200 (i.e., provide cushioning), further facilitating the catching of balls and the protection of the hand from pain and discomfort associated with impacts with balls.

Given that various aspects of the present invention relate primarily to dorsal force attenuation system 290, other portions of second ball glove 200, including palmar panel 210, dorsal panel 220, and webbing 260, may exhibit the general configuration discussed above or the general configuration of any other ball glove. Accordingly, the structure of second ball glove 200 may vary significantly.

Dorsal Force Attenuation System Configuration

Dorsal force attenuation system 290 is located within second ball glove 200 to protect portions of an index finger of the hand. As discussed in greater detail below, dorsal force attenuation system 290 has the configuration of a fluid-filled chamber. In this configuration, dorsal force attenuation system 290 effectively attenuates impact forces or otherwise cushions impacts from balls being caught with second ball glove 200. Various configurations of dorsal force attenuation system 290 enclose a fluid (e.g., gas or liquid) to attenuate impact forces or otherwise cushion impacts from balls being caught with second ball glove 200.

Figure 13A:
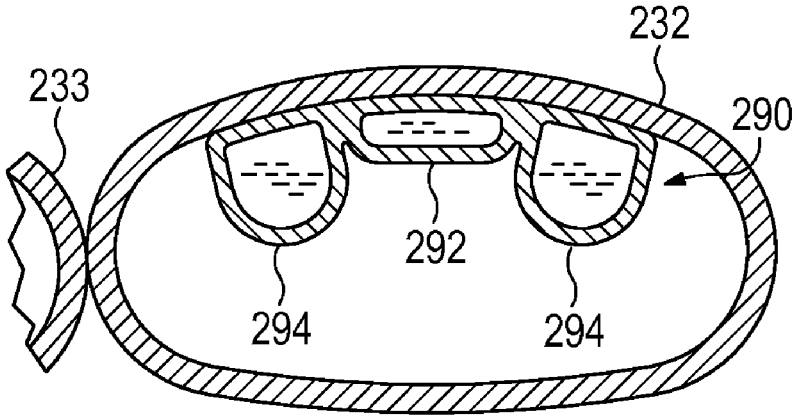
FIGS. 13A and 13B are cross-sectional views of the second ball glove, as respectively defined by section lines 13A and 13B in FIG. 11.
Figure 13B:
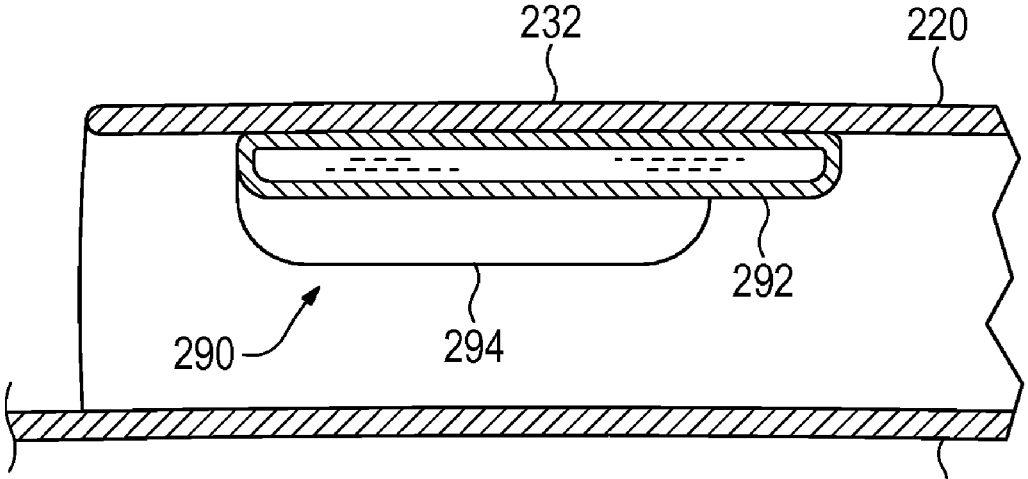
Figure 14:
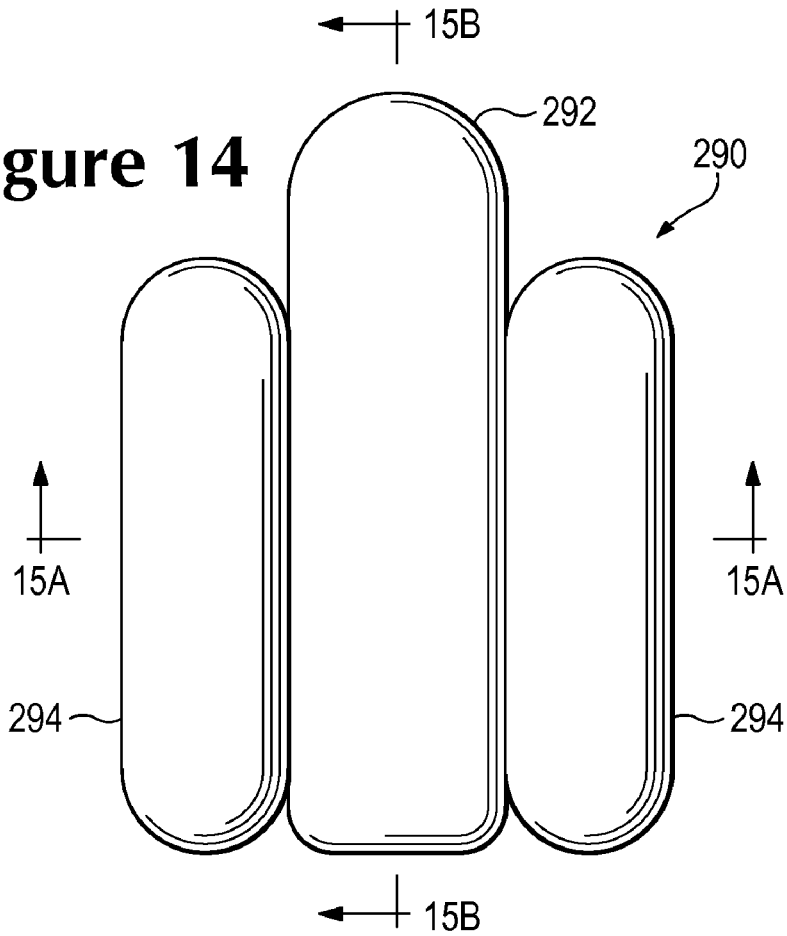
FIG. 14 is a top plan view of a dorsal force attenuation system of the second ball glove.
Figure 15A:
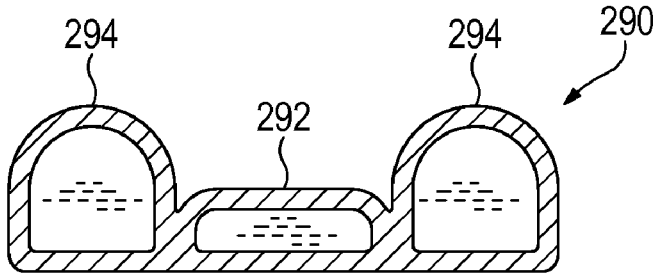
FIGS. 15A and 15B are cross-sectional views of the dorsal force attenuation system, as respectively defined by section lines 15A and 15B in FIG. 14.
Figure 15B:
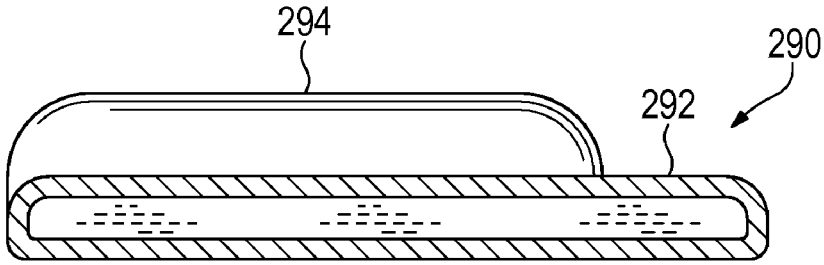

When incorporated into second ball glove 200, dorsal force attenuation system 290 may be secured to dorsal panel 220 along portions of dorsal panel 220 generally corresponding to an index finger, including portions of second finger stall 232, as depicted in FIGS. 13A and 13B. In this position, dorsal force attenuation system 290 is located to extend between the index finger and portions of palmar panel 210 where balls often impact second ball glove 200, to protect the index finger of the hand from impacts due to catching balls With reference to FIGS. 14 through 15B, in the initial configuration of second ball glove 200, dorsal force attenuation system 290 includes at least one chamber sealed to enclose a fluid and may be formed of a polymer material. A wide range of polymer materials may be utilized for dorsal force attenuation system 290, including any of the materials discussed above for palmar force attenuation system 170. Additionally, any of the fluids and pressures discussed above for palmar force attenuation system 170 may also be utilized within dorsal force attenuation system 290.

Dorsal force attenuation system 290 is secured to an inner surface of dorsal panel 220 near dorsal aperture 221 and is substantially aligned with second finger stall 232. Dorsal force attenuation system 290 has a central chamber 292 and two side chambers 294. Central chamber 292 is wider than it is tall and is longer than side chambers 294, and side chambers 294 are substantially cylindrical. Central chamber 292 and side chambers 294 may or may not be in fluid communication with each other.

The index finger of the hand may extend through dorsal aperture 221 and rest on an exterior surface of dorsal panel 220. Impact from a ball caught within the pocket of second ball glove 200 may apply a force to the hand, such as areas of the hand including the index finger as extended through dorsal aperture 221. Accordingly, dorsal force attenuation system 290 is located in second ball glove 200 so that the index finger of the hand may rest adjacent to central chamber 292 and between side chambers 294, in order to protect the index finger from impacts due to catching balls, particularly when the index finger extends through dorsal aperture 221 and rests on an exterior surface of dorsal panel 220.

Based upon the above discussion, dorsal force attenuation system 290 is incorporated into second ball glove 200 adjacent to dorsal panel 220 in areas corresponding to the index finger, in order to protect the hand from impacts due to catching balls.

Further Configurations

The above discussion of second ball glove 200 and dorsal force attenuation system 290 provides examples of suitable configurations. As discussed below, however, both second ball glove 200 and dorsal force attenuation system 290 may exhibit a variety of other configurations.

In the initial configuration of second ball glove 200, finger stalls 232-235 correspond to an index finger, a middle finger, a ring finger, and a little finger of the hand, and finger voids 252-255 for receiving the index finger, the middle finger, the ring finger, and the little finger are respectively located within finger stalls 232-235. In alternate configurations, one or more of finger stalls 232-235 may be replaced with a single finger stall that corresponds to more than one of the index finger, the middle finger, the ring finger, and the little finger of the hand. In such cases, each of finger voids 252-255 still exists, but may be located within a different finger stall than in the original configuration of second ball glove 200. For example, in an alternate configuration of second ball glove 200, in which second ball glove 200 is a mitt, finger stall 232 may correspond to the index finger, the middle finger, the ring finger, and the little finger of the hand, and finger voids 252-255 for receiving the index finger, the middle finger, the ring finger, and the little finger are all located within finger stall 232.

Figure 16A:
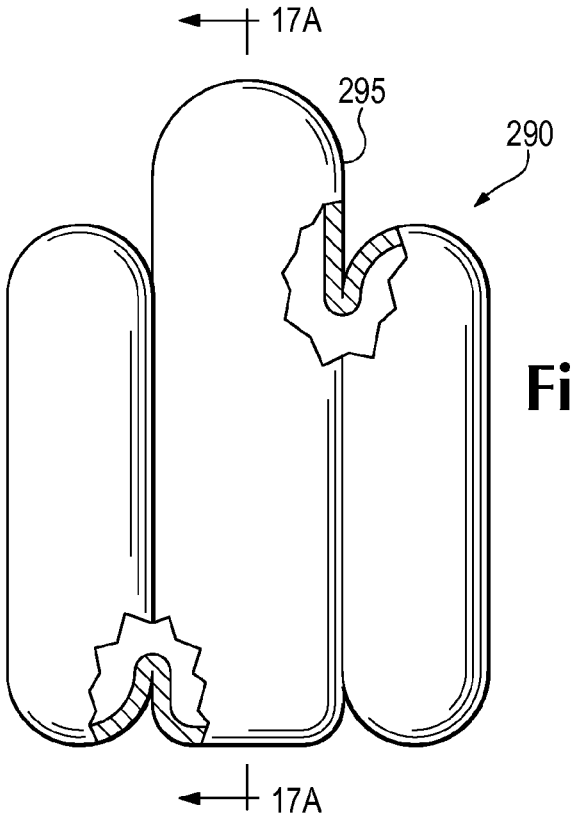
FIGS. 16A-16C are top plan views of further configurations of the dorsal force attenuation system.
Figure 17A:
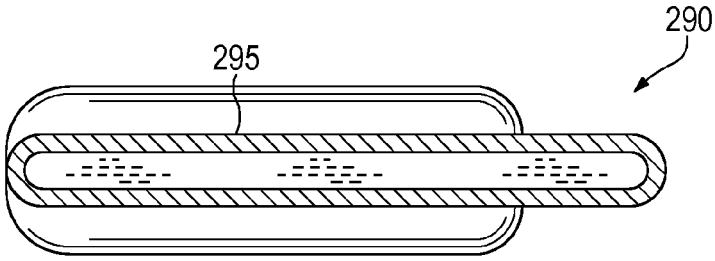
FIG. 17A-17C are cross-sectional views of the further configurations of the dorsal force attenuation system, as respectively defined by section lines 17A-17C in FIGS. 16A-16C.

In the initial configuration of second ball glove 200, dorsal force attenuation system 290 has a central chamber 292 and two side chambers 294, central chamber 292 being wider than it is tall and longer than side chambers 294, and side chambers 294 being substantially cylindrical. In alternate configurations, dorsal force attenuation system 290 may be a single chamber having portions analogous to the side chambers 294 and central chamber 292 of the initial configuration of second ball glove 200. For example, with reference to FIGS. 16A and 17A, dorsal force attenuation system 290 may be a single chamber 295 with a central portion and two side portions, the central portion being wider than it is tall and longer than the side portions, the side portions being substantially cylindrical, and the central portion and the side portions being in fluid communication with each other.

Figure 16B:
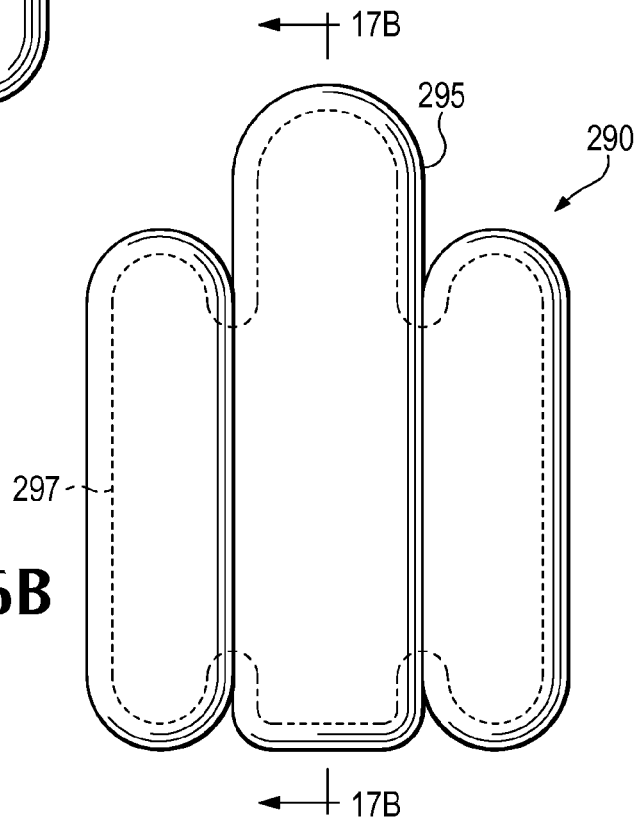
Figure 17B:
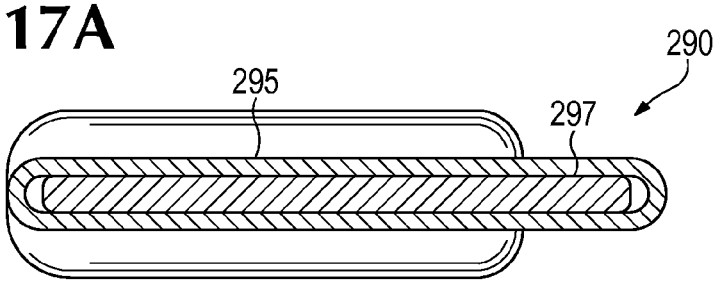

In the initial configuration of second ball glove 200, dorsal force attenuation system 290 encloses a fluid. In alternate configurations, a variety of elements may be located within dorsal force attenuation system 290, either in addition to or in place of the fluid. The elements that may be located within dorsal force attenuation system 290 include foam structures and any of the structures, elements, or materials discussed above for use in palmar force attenuation system 170. For example, with reference to FIGS. 16B and 17B, a foam structure 297 is located within chamber 295. Additionally, the elements that may be located within dorsal force attenuation system 290 may be bonded to one or more internal surfaces of force attenuation system 290. Furthermore, in configurations of dorsal force attenuation system 290 having a plurality of chambers, the elements located within dorsal force attenuation system 290 (e.g., foam) may be located within one or more of the plurality of chambers, but may be absent from others.

Figure 18A:
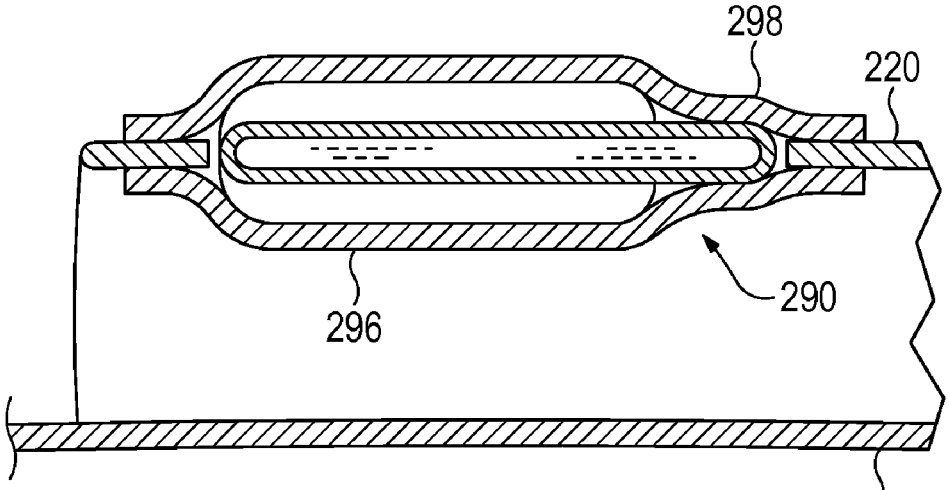
FIGS. 18A-18B are cross-sectional views corresponding with FIG. 13B and depicting further configurations of the second ball glove.
Figure 19A:
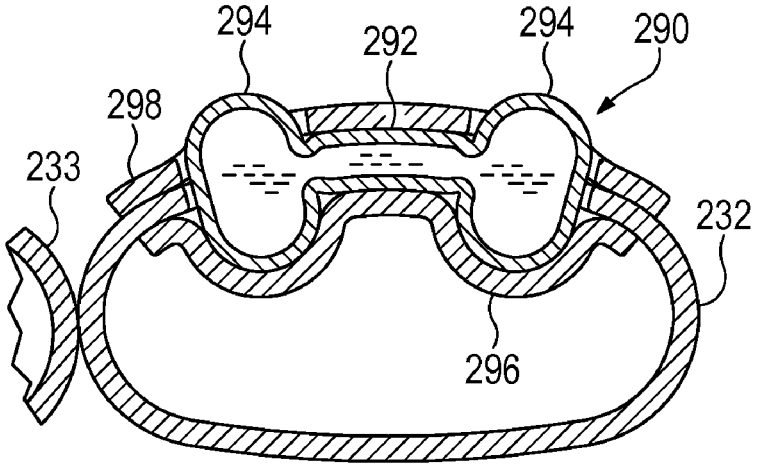
FIGS. 19A-19B are cross-sectional views corresponding with FIG. 13A and depicting further configurations of the second ball glove.
Figure 19B:
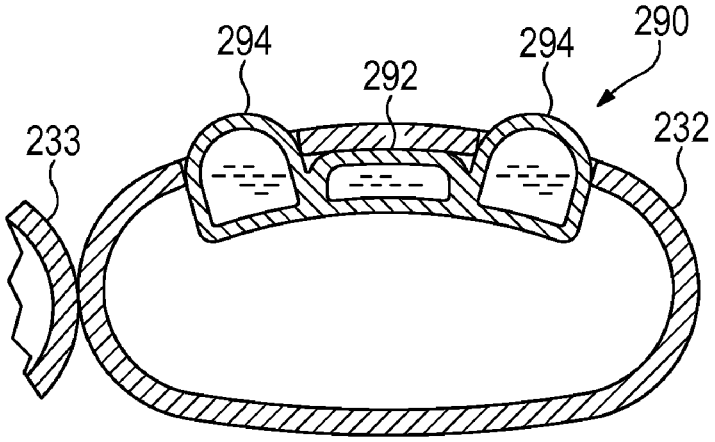

In the initial configuration of second ball glove 200, dorsal force attenuation system 290 is secured to an inner surface of dorsal panel 220. In alternate configurations, dorsal force attenuation system 290 is secured to dorsal panel 220 by an inner dorsal panel 296 and an outer dorsal panel 298. For example, with reference to FIG. 18A, dorsal force attenuation system 290 may be secured to dorsal panel 220 on one side by an inner dorsal panel 296 (secured to an inner surface of dorsal panel 220) and on the other side by an outer dorsal panel 298 (secured to an outer surface of dorsal panel 220). In other alternate configurations, some or all of side chambers 294 may be exposed through apertures in outer dorsal panel 298. For example, with reference to FIG. 19A, side chambers 294 may be exposed through apertures in outer dorsal panel 298 along substantially all of their length. Alternatively, with reference to FIG. 19B, dorsal force attenuation system 290 may be secured to an inner surface of dorsal panel 220, and side chambers 294 may be exposed through apertures in the dorsal panel.

In the initial configuration of second ball glove 200, central chamber 292 is longer than side chambers 294. In alternate configurations, central chamber 292 may be approximately the same length as side chambers 294. In other alternate configurations, central chamber 292 may be shorter than side chambers 294.

In the initial configuration of second ball glove 200, central chamber 292 is wider than it is deep, and side chambers 294 are substantially cylindrical. In other alternate configurations, central chamber 292 may be substantially cylindrical, or may be substantially square or rectangular in cross-section, and side chambers 294 may be taller than they are wide.

Figure 16C:
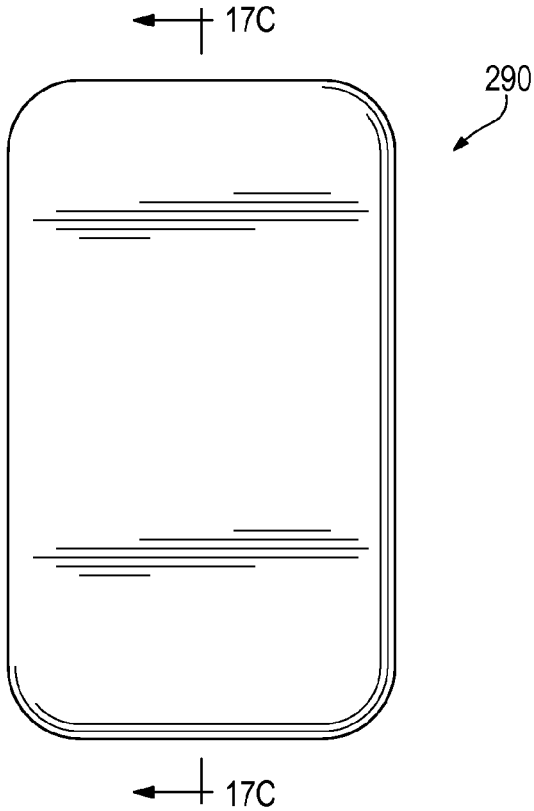
Figure 17C:
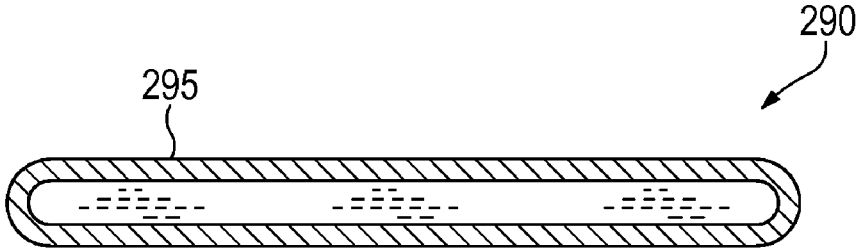
Figure 18B:
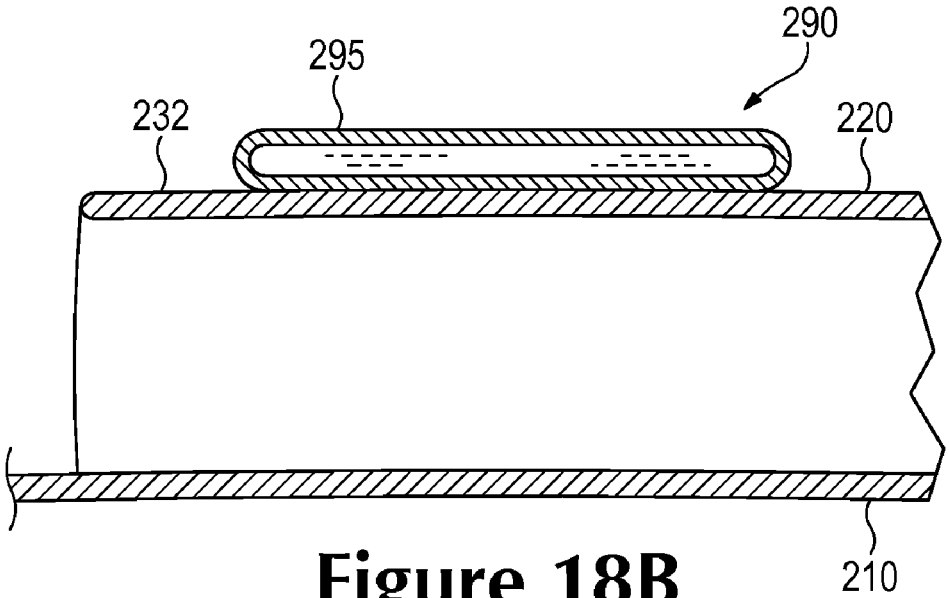

In the initial configuration of second ball glove 200, dorsal force attenuation system 290 has a central chamber and two side chambers. In alternate configurations, dorsal force attenuation system 290 may have a single chamber with depth and length substantially greater than its height, positioned at least between dorsal aperture 221 and second finger stall 232. For example, with reference to FIGS. 16C, 17C, and 18B, dorsal force attenuation system 290 may have only a single chamber 295, and may be positioned on an outer surface of dorsal panel 220 between dorsal aperture 221 and second finger stall 232.

In summary, second ball glove 200 may have a configuration suitable for use as a mitt. Additionally, dorsal force attenuation system 290 may have a central chamber and side chambers of various widths, heights, lengths, and cross-sectional shapes. Alternatively, dorsal force attenuation system 290 may have a single chamber.

Figure 20:
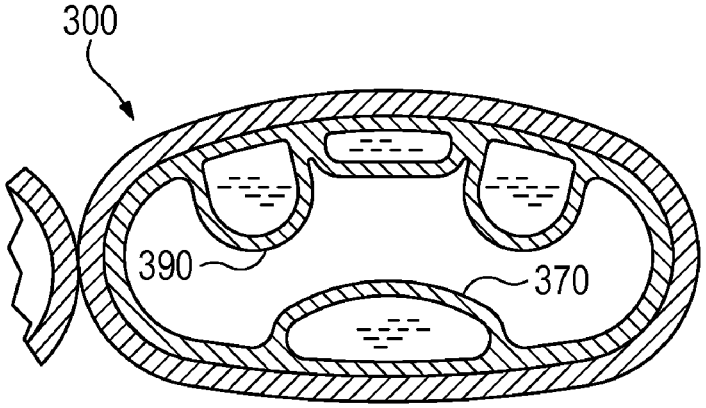
FIG. 20 is a cross-sectional view of a third ball glove.

Ball gloves may also incorporate a palmar force attenuation system, a dorsal force attenuation system, or both. In a ball glove incorporating both a palmar force attenuation system and a dorsal force attenuation system, the palmar force attenuation system may optionally be of unitary construction with the dorsal force attenuation system. Where the palmar force attenuation system and the dorsal force attenuation system are of unitary construction with each other, portions of the palmer force attenuation system and the dorsal force attenuation system may also optionally be in fluid communication with each other. For example, with reference to FIG. 20, a third ball glove 300 incorporates both a palmar force attenuation system 370 and a dorsal force attenuation system 390, which are of unitary construction with each other.

The palmar force attenuation systems and dorsal force attenuation systems disclosed above, when incorporated into ball gloves, may serve to protect a wearer's hand from discomfort and soreness due to repeated impacts from catching a ball.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A ball glove comprising:

a palmar panel defining a front surface of the glove and a dorsal panel defining a back surface of the glove, the palmar panel and the dorsal panel being coupled together to (a) define a first finger stall, a second finger stall, a third finger stall, a fourth finger stall, and a fifth finger stall, and (b) define a hand cavity for receiving a hand of a wearer that includes a palm void, a first finger void within the first finger stall, a second finger void within the second finger stall, a third finger void within the third finger stall, a fourth finger void within the fourth finger stall, and a fifth finger void within the fifth finger stall, the finger voids extending outward from the palm void;

a webbing secured to at least one of the palmar panel and the dorsal panel and positioned between the first finger void and the second finger void; and a force attenuation system including at least one chamber sealed to enclose both a fluid and a foam structure, a majority of the force attenuation system being positioned between (a) the front surface of the glove and (b) the second finger void, a portion of the palm void adjacent to the second finger void, and a portion of the palm void adjacent to the third finger void.

2. The ball glove of claim 1, wherein the foam structure is bonded to an internal surface of the chamber.

3. The ball glove of claim 1, wherein the at least one chamber includes (a) a first chamber positioned adjacent to the second finger void of the glove and (b) a second chamber positioned adjacent to the palm void.

4. The ball glove of claim 1, wherein the at least one chamber includes (a) a first chamber positioned between the front surface and the second finger void, (b) a second chamber positioned between the front surface and a portion of the palm void adjacent to the second finger void, and (c) a third chamber positioned between the front surface and a portion of the palm void adjacent to the third finger void.

5. A ball glove comprising:

a palmar panel defining a front surface of the glove and a dorsal panel defining a back surface of the glove, the palmar panel and the dorsal panel being coupled together to (a) define a first finger stall, a second finger stall, a third finger stall, a fourth finger stall, and a fifth finger stall, and (b) define a hand cavity for receiving a hand of a wearer that includes a palm void, a first finger void, a second finger void, a third finger void, a fourth finger void, and a fifth finger void, the finger voids extending outward from the palm void;

a webbing secured to at least one of the palmar panel and the dorsal panel and positioned between the first finger void and the second finger void; and a force attenuation system including at least one chamber sealed to enclose both a fluid and a foam structure, the force attenuation system being positioned (a) between the front surface of the glove and a portion of the hand cavity that includes a portion of the palm void, and (b) at least partially within the second finger stall, the force attenuation system being L-shaped, wherein the at least one chamber includes (a) a first chamber positioned within the second finger stall of the glove and (b) a second chamber positioned adjacent to the palm void.

6. The ball glove of claim 5, wherein the foam structure is bonded to an internal surface of the chamber.

7. The ball glove of claim 5, wherein the at least one chamber includes (a) a first chamber positioned between the front surface and the second finger void within the second finger stall, (b) a second chamber positioned between the front surface and a portion of the palm void adjacent to the second finger stall, and (c) a third chamber positioned between the front surface and a portion of the palm void adjacent to the third finger stall.

8. A ball glove comprising:

a palmar panel defining a front surface of the glove and a dorsal panel defining a back surface of the glove, the palmar panel and the dorsal panel being coupled together to define a hand cavity for receiving a hand of a wearer;

a webbing secured to at least one of the palmar panel and the dorsal panel; and a force attenuation system including at least one chamber that is sealed to enclose both a fluid and a foam structure, a majority of the force attenuation system being positioned between the front surface of the glove and the hand cavity.

9. The sports glove of claim 8, wherein the foam element is bonded to an internal surface of the chamber.

10. The ball glove of claim 8, wherein the hand cavity includes a palm void, a first finger void, a second finger void, a third finger void, a fourth finger void, and a fifth finger void, the finger voids extending outward from the palm void, and a majority of the force attenuation system is located adjacent to the second finger void, a portion of the palm void adjacent to the second finger void, and a portion of the palm void adjacent to the third finger void.

11. The ball glove of claim 8, wherein the hand cavity includes a palm void, a first finger void, a second finger void, a third finger void, a fourth finger void, and a fifth finger void, the finger voids extending outward from the palm void, and the at least one chamber includes (a) a first chamber positioned adjacent to the second finger void and (b) a second chamber positioned adjacent to the palm void.

12. The ball glove of claim 8, wherein the hand cavity includes a palm void, a first finger void, a second finger void, a third finger void, a fourth finger void, and a fifth finger void, the finger voids extending outward from the palm void, and the at least one chamber includes (a) a first chamber positioned between the front surface and the second finger void, (b) a second chamber positioned between the front surface and a portion of the palm void adjacent to the second finger void, and (c) a third chamber positioned between the front surface and a portion of the palm void adjacent to the third finger void.

13. The ball glove of claim 8, wherein the force attenuation system is L-shaped.

14. A ball glove comprising:

a palmar panel defining a front surface of the glove and a dorsal panel defining a back surface of the glove, the palmar panel and the dorsal panel being coupled together to define a first finger stall, a second finger stall, a third finger stall, a fourth finger stall, and a fifth finger stall, and the glove defining a hand cavity for receiving a hand of a wearer, the hand cavity being located between the palmar panel and the dorsal panel and including a palm void, a first finger void within the first finger stall, a second finger void within the second finger stall, a third finger void within the third finger stall, a fourth finger void within the fourth finger stall, and a fifth finger void within the fifth finger stall, the finger voids extending outward from the palm void a webbing secured to at least one of the palmar panel and the dorsal panel and positioned between the first finger void and the second finger void; and a force attenuation system including at least one chamber sealed to enclose a gas, the force attenuation system being secured to a portion of the dorsal panel defining the second finger stall.

15. The ball glove of claim 14, wherein the force attenuation system is adjacent to the second finger void.

16. The ball glove of claim 14, wherein the force attenuation system comprises a central chamber and at least one side chamber.

17. The ball glove of claim 14, wherein the dorsal panel defines an aperture extending from the back surface to the hand cavity, the force attenuation system being adjacent to the second finger void and the aperture.

18. A ball glove comprising:

a palmar panel defining a front surface of the glove and a dorsal panel defining a back surface of the glove, the palmar panel and the dorsal panel being coupled together to define a hand cavity for receiving a hand of a wearer, the hand cavity including a palm void, a first finger void, a second finger void, a third finger void, a fourth finger void, and a fifth finger void, the finger voids extending outward from the palm void;

a webbing secured to at least one of the palmar panel and the dorsal panel;

a palmar force attenuation system including at least one chamber sealed to enclose a fluid and containing a foam structure, the palmar force attenuation system being positioned between (a) the front surface of the glove and (b) the hand cavity; and a dorsal force attenuation system including at least one chamber sealed to enclose a fluid, the dorsal force attenuation system being positioned between (a) the back surface of the glove and (b) the hand cavity, wherein the dorsal force attenuation system is substantially absent from portions of the glove adjacent to the first finger void, the third finger void, the fourth finger void, and the fifth finger void, and is positioned adjacent to the second finger void.

19. The ball glove of claim 5, wherein the force attenuation system (a) is positioned in portions of the glove adjacent to the second finger void and the third finger void, and (b) is substantially absent from portions of the glove adjacent to other portions of the palm void.

* * * * *